US008885834B2

(12) United States Patent
Kuhr et al.

(10) Patent No.: US 8,885,834 B2
(45) Date of Patent: Nov. 11, 2014

(54) METHODS AND DEVICES FOR REPRODUCING SURROUND AUDIO SIGNALS

(75) Inventors: Markus Kuhr, Wedemark (DE); Jurgen Peissig, Wedemark (DE); Axel Grell, Wedemark (DE); Gregor Zielinsky, Wedemark (DE); Juha O Merimaa, Menlo Park, CA (US); Veronique Larcher, San Francisco, CA (US); David Romblom, San Francisco, CA (US); Bryan Austin Cook, Silver Spring, MD (US); Heiko Zeuner, Bernau Bei Berlin (DE)

(73) Assignees: Sennheiser electronic GmbH & Co. KG, Wedemark (DE); Sennheiser Electronic Corporation, Old Lyme, CT (US)

( * ) Notice: Subject to any disclaimer, the term of this patent is extended or adjusted under 35 U.S.C. 154(b) by 896 days.

(21) Appl. No.: 12/920,578

(22) PCT Filed: Mar. 9, 2009

(86) PCT No.: PCT/US2009/036575
§ 371 (c)(1),
(2), (4) Date: Dec. 17, 2010

(87) PCT Pub. No.: WO2009/111798
PCT Pub. Date: Sep. 11, 2009

(65) Prior Publication Data

US 2011/0135098 A1 Jun. 9, 2011

(30) Foreign Application Priority Data

Mar. 7, 2008 (EP) ..... 08152448

(51) Int. Cl.
*H04R 5/00* (2006.01)
*H04S 3/00* (2006.01)

(52) U.S. Cl.
CPC ..... *H04S 3/004* (2013.01)
USPC ..... 381/17; 381/307; 381/56; 381/61; 381/80

(58) Field of Classification Search
USPC ..... 381/1, 2, 3, 5, 10, 13, 15, 17, 18, 19, 381/20, 21, 22, 23, 307, 309, 310, 27, 28, 381/56, 61, 63, 64, 66, 71.1, 71.11, 71.12, 381/80, 82, 332, 94.1, 94.3, 94.8, 98, 99, 381/100, 101, 102, 103, 106, 119, 120; 700/94; 455/3.06, 3.01; 708/300, 301, 708/308, 314, 315, 316, 323, 420
See application file for complete search history.

(56) References Cited

U.S. PATENT DOCUMENTS 5,371,799 A 12/1994 Lowe et al.
6,078,669 A 6/2000 Maher (Continued)

FOREIGN PATENT DOCUMENTS

WO WO 02/098172 A2 12/2002

OTHER PUBLICATIONS

Kendall, G., et al., "A Spatial Sound Processor for Loudspeaker and Headphone Reproduction," *AES 8th International Conference*, p. 209-221 (May 30, 1990).

(Continued)

*Primary Examiner* — Leshui Zhang
(74) *Attorney, Agent, or Firm* — Kilpatrick Townsend & Stockton LLP

(57) ABSTRACT

Method and devices for providing surround audio signals are provided. Surround audio signals are received and are binaurally filtered by at least one filter unit. In some embodiments, the input surround audio signals are also processed by at least one equalizing unit. In those embodiments, the binaurally filtered signals and the equalized signals are combined to form output signals.

11 Claims, 18 Drawing Sheets

(56) References Cited

U.S. PATENT DOCUMENTS

| | | | | |
|---|---|---|---|---|
| 6,118,875 | A | 9/2000 | Møller et al. | |
| 6,370,256 | B1 | 4/2002 | McGrath | |
| 6,978,027 | B1 | 12/2005 | Dahl et al. | |
| 6,990,205 | B1 | 1/2006 | Chen | |
| 7,099,482 | B1 * | 8/2006 | Jot et al. | 381/61 |
| 2002/0067836 | A1 | 6/2002 | Paranjpe | |
| 2002/0164037 | A1 | 11/2002 | Sekine | |
| 2007/0172086 | A1 * | 7/2007 | Dickins et al. | 381/309 |

OTHER PUBLICATIONS

Smith, J., "Chapter 6: Transfer Function Analysis," Introduction to Digital Filters, p. 121-129 (2007, W3K Publishing, http://www.w3k.org).

J. O. Smith, "Spectral Audio Signal Processing", Center for Computer Research in Music and Acoustics (CCRMA), Stanford University, Mar. 2007 Version, http://ccrma.stanford.edu/~jos/sasp/Time_Varying_OLA_Modifications.html.

* cited by examiner

```
W = half-window length
B = block size
F = filter length
N = fft length = nextpow2(B + W + F - 1)
O = overlap size = N - B
```

FIG. 9D

```
Real window[2*W];  (constant)
Real input[N]; (temporary, used to form signal for FFT)
Real in_overlap[W]; (used as a delay line)
Complex freq_data[N/2 + 1];
```

FIG. 9E

```
InputTransform(block[B]) {
      input[0 … W-1] = in_overlap[0 … W-1]; // Copy the saved overlap
      input[W … W + B - 1] = block[0 … B-1]; // Copy the input block
      input[W + B … N-1] = 0; // Zeros at the end
      in_overlap[0 ... W-1] = input[N - O … N - O + W - 1]; // Save tail
      input[0 … W-1] *= window[0 … W-1];          // Apply the "up" window
      input[N - O … N - O + W - 1] *= window[W … 2*W-1]; //  "down" window
      freq_data = fft(input);
}
```

FIG. 9F

```
      Real input[N];  (temporary, used to form signal for FFT)
      Complex freq_data[N/2 + 1];

FilterTransform(filter[F]) {
      input[0 … F-1] = filter[0 … F-1];
      input[F … N-1] = 0;
      freq_data = fft(input);
}
```

FIG. 9G

```
      Real output[N];  (temporary, used for the output of the FFT
      Real out_overlap[O]; (overlap region)
      Complex freq_data[N/2 + 1];

 block[B] = OutputTransform() {
      output = ifft(freq_data);
      output[0 … O-1] += out_overlap[0 … O-1]; // Add previous overlap
      out_overlap[0 … O-1] = output[N - O … N-1]; // Save overlap
      block[0 … B-1] = output[0 … B-1]; // Copy the block
 }
```

FIG. 9H

METHODS AND DEVICES FOR REPRODUCING SURROUND AUDIO SIGNALS

This application is a U.S. National Stage of PCT/US2009/036575, filed Mar. 9, 2009, which claims priority to European patent application No. EP-08152448.0, filed Mar. 7, 2008, the contents of which are herein incorporated by reference in their entirety.

This application claims priority to European patent application No. EP-08152448.0, filed Mar. 7, 2008.

The present invention relates to a method for reproducing surround audio signals.

Audio systems as well as headphones are known, which are able to produce a surround sound.

FIG. 1 shows a representation of a typical 5.1 surround sound system with five speakers which are positioned around the listener to give an impression of an acoustic space or environment. Additional surround sound systems using six, seven, or more speakers (such as surround sound standard 7.1) are in development, and the embodiments of the present invention disclosed herein may be applied to these upcoming standards as well, as well as to systems using three or four speakers.

Headphones are also known, which are able to produce a 'surround' sound such that the listener can experience for example a 5.1 surround sound over headphones or earphones having merely two electric acoustic transducers.

FIG. 2 shows a representation of the effect of direct and indirect sounds. If a convincing impression of a surround sound is to be reproduced over a headphone or an earphone, then the interaction of the sound with the room, our head and our ears may be emulated, i.e., direct sound DS, and room effects RE having early reflections ER and late reverberations LR. This can for example be performed by digitally recording acoustic properties of a room, i.e. the so-called room impulse responses. By means of the room impulse responses a complex filter can be created which processes the incoming audio signals to create an impression of surround sound. This processing is similar to that used for high-end convolution reverbs or reverberation. A simplified model of a room impulse response can also be used to make a real-time implementation less resource intensive, at the expense of the accuracy of the audio representation of the room. The reproduction of direct sound DS and room effect RE by means of convolution or by means of a model will be denoted by "Room Reproduction."

On the one hand, the Room Reproduction may create an impression of an acoustic space and may create an impression that the sound comes from outside the user's head. On the other hand, the Room Reproduction may also color the sound, which can be unacceptable for high fidelity listening.

Accordingly, it is an object of the invention to provide a method for reproducing audio signals such that the auditory spatial and timbre cues are provided such that the human brain has the impression that a multichannel audio content is played.

This object is solved by a method according to claim 1.

This object is solved by a method for providing surround audio signals. Input surround audio signals are received and are binaurally filtered by means of at least one filter unit. On the input surround audio signals, a binaural equalizing processing is performed by at least one equalizing unit. The binaurally filtered signals and the equalized signals are combined as output signals.

According to an aspect of the invention, the filtering and the equalizing processing are performed in parallel.

Furthermore, the filtered and/or equalized signals can be weighted.

Furthermore, in a real-time implementation, the amount of room effect RE included in both signal paths can be weighted, The invention also relates to a surround audio processing device. The device comprises an input unit for receiving surround audio signals, at least one filter unit for binaurally filtering the received input surround audio signals and at least one equalizing unit for performing a binaural equalizing processing on the input surround audio signals. The output signals of the filter units and the output signals of the equalizing units are combined.

Optionally, the binaural filtering unit can comprise a room model reproducing the acoustics of a target room, and may optionally do so as accurately as computing and memory resources allow for.

According to a further aspect of the invention, the surround audio processing device comprises a first delay unit arranged between the input unit and at least one equalizing unit for delaying the input surround audio signal before it is processed by the equalizing unit. The device furthermore comprises a second delay unit for delaying the output of the at least one equalizing unit.

According to a further aspect of the invention, the device comprises a controller for weighting the output signals of the filter units and/or the output signals of the equalization units.

The invention also relates to a headphone comprising an above described surround audio processing device.

The invention also relates to a headphone which comprises a head tracker for determining the position and/or direction of the headphone and an audio processing unit. The audio processing unit comprises at least one filter unit for binaurally filtering the received input surround audio signals and at least one equalizing unit for performing a binaural equalizing processing on the input surround audio signals. The output signals of the filter units and the equalizing units are combined as output signals.

The invention relates to a headphone reproduction of multichannel audio content, a reproduction on a home theatre system, headphone systems for musical playback and headphone systems for portable media devices. Here, binaural equalization is used for creating an impression of an acoustic space without coloring the audio sound. The binaural equalization is useful for providing excellent tonal clarity. However, it should be noted that the binaural equalization is not able to provide an externalization of a room impulse response or of a room model, i.e. the impression that the sound originates from outside the user's head. An audio signal convolved or filtered with a binaural filter providing spaciousness (with a binaural room impulse response or with a room model) and the same audio signal which is equalized, for example to correct for timbre changes in the filtered sound, is combined in parallel.

Optionally directional bands can be used during the creation of an equalization scheme for compensating for timbre changes in binaurally recorded sound or binaurally processed sound. Furthermore, stereo widening techniques in combination with the direction of frequency band boosting can be used in order to externalize an equalized signal which is added to a process sound to correct for timbre changes. Accordingly, a virtual surround sound can be created in a headphone or an earphone, in portable media devices or for a home theatre system. Furthermore, a controller can be provided for weighting the audio signal convolved or filtered with a binaural impulse response or the audio signal equalized to correct for timbre changes. Therefore, the user may decide for himself which setting is best for him.

By means of an equalizer that excites frequency bands corresponding to spatial cues, the spatial cues already rendered by the binaural filtering are reinforced or do not lead to an alteration of the spatial cues. By separating the rendering of the spatial cues provided by the binaural filters and by rendering the correct timbre by providing the equalizer, a flexible solution is provided which can be tuned by the end-user, wherein he can choose whether he wishes more spaciousness vs. more timbre preservation.

Other aspects of the invention are defined in the dependent claims.

Advantages and embodiments of the invention are now described in more detail with reference to the figures.

FIGS. 9D-9H show pseudo code used in a modified window overlap-add method for smoothing time-varying parameters convolved in the frequency range according to an embodiment;

It should be noted that "Ipsi" and "Ipsilateral" relate to a signal which directly hits a first ear while "contra" and "contralateral" relate to a signal which arrives at the second ear. If in FIG. 1 a signal is coming from the left side, then the left ear will be the Ipsi and the right ear will be contra.

Figure 3A:
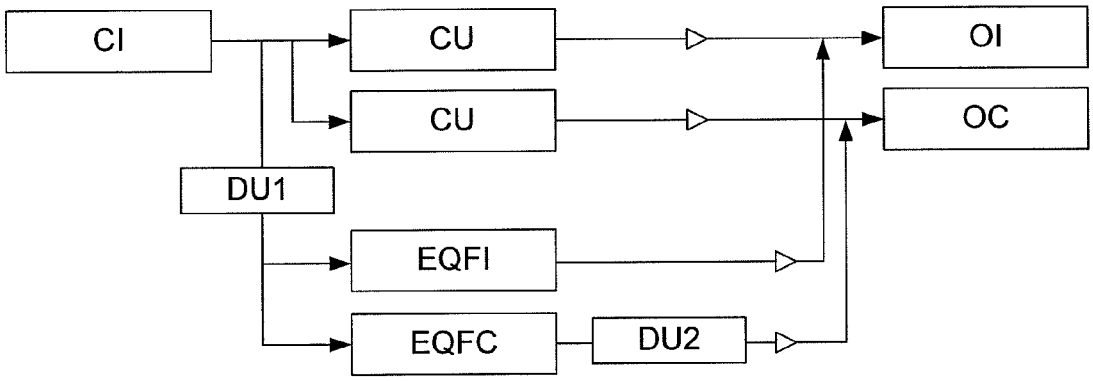
FIG. 3A shows a block diagram of a surround audio processing unit and a signal diagram according to a first embodiment of the invention.

FIG. 3A shows a block diagram of a surround audio processing unit and a signal diagram according to a first embodiment of the invention. Here, an input channel CI of surround audio is provided to filter units or convolution units CU and a set of equalization filters EQFI, EQFC in parallel. The filter units or the convolution units CU can also be implemented by a real-time filter processor. The surround input audio signal can be delayed by a first delay unit DU1 before it is inputted in the equalization filters EQFI, EQFC. The first delay unit DU1 is provided in order to compensate for the processing time of the filter unit or the convolution unit CU (or the filter processor). The equalization filter EQFC constitutes the contra-lateral equalization output which is delayed by a second delay unit DU2. The effect of this delay of for example approximately 0.7 ms is to create an ITD effect. The convolution or filter units CU output their output signals to the output OI, OC (output Ipsi, output Contra) in parallel, where the outputs of the filter unit CU and the output of the first equalization unit ECFI and the output of the second delay unit is combined in parallel. The outputs of the equalization units EQFC, EQFI can optionally go through a stereo widening process. Here, the signals can be phase-inverted, reduced in their level and added to the opposite channel in order to widen the image to improve the effect of externalization.

In some embodiments, the filter units CU can cause attenuation in the low frequencies (e.g., 400 Hz and below) and in the high frequencies (e.g., 4 Hz and above) in the audio signals presented at the ears of the user. Also, the sound that is presented to the user can have many frequency peaks and notches that reduce the perceived sound quality. In these embodiments, the equalization filters EQFI, EQFC may be used to construct a flat-band representation of right and left signals (without externalization effects) for the user's ears which compensates for the above-noted problems. In other embodiments, the equalization filters may be configured to provide a mild amount of boost (e.g., 3 dB to 6 dB) in the above-noted low and high frequency ranges. As illustrated in the embodiment shown in FIG. 4 and discussed below, the equalization filters may include delay blocks and gain blocks that model the ILD and ITD of the user in relation to the sources. The values of these delay and gain blocks may be readily derived from head-related transfer functions (HRTFs) by one of ordinary skill in the audio art without undue experimentation.

Figure 3B:
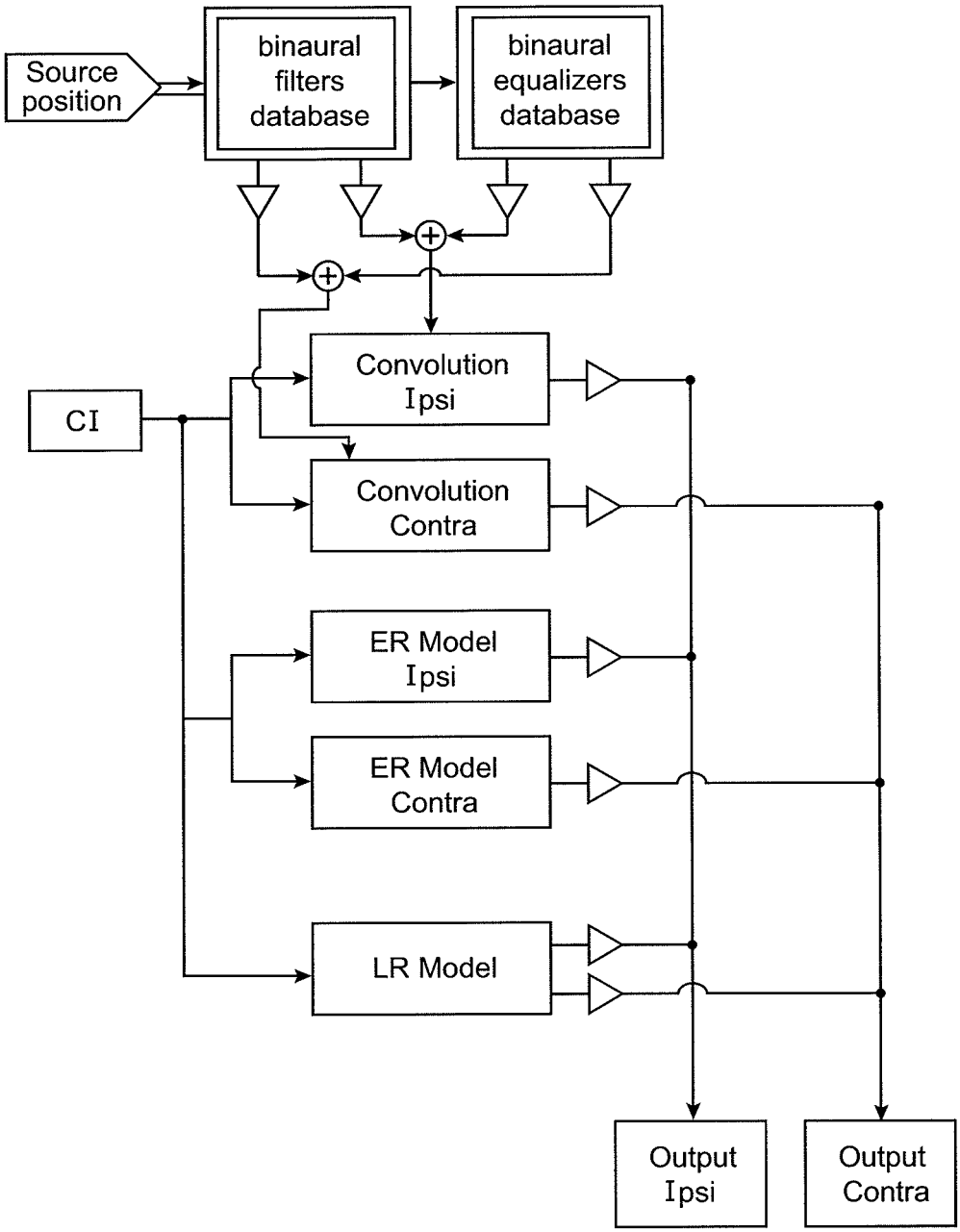
FIG. 3B shows a block diagram of a surround audio processing unit and a signal diagram according to another embodiment.

FIG. 3*b* shows a block diagram of a surround audio processing unit according to another embodiment of the invention. The processing unit may be used in headphones or other suitable sound sources. Here, an input channel CI of surround audio is split and provided to three groups of filters: convolution filters (to reproduce direct sound DS), ER model filters (to reproduce early reflections ER), and an LR model filter (to reproduce late reverberations LR). In certain embodiments, there may be two each of the convolution filters and the ER model filters—one each for contra and one each for Ipsi. In exemplary embodiments, the surround audio processing unit shown in FIG. 3*b* does not require an equalizer unit. Rather, the output Ipsi and output Contra can sound accurate as is. In certain embodiments, a surround audio signal can optionally be provided to the filters and the equalizers in parallel. The filters can also be implemented by a real-time processor. In certain embodiments, the filters can incorporate equalizer processing concurrently with filtering, by using coefficients stored in the Binaural Equalizers Database.

Binaural Filters Database and Binaural Equalizers Database can store the coefficients for the filter units or convolution units. The coefficients can optionally be based upon a given "virtual source" position of a loud speaker. The auditory image of this "virtual source" can be preserved despite the head movements of the listener thanks to a head tracker unit as described with respect to FIG. 5. Coefficients from the Binaural Filters Database can be combined with coefficients from the Binaural Equalizers Database and be provided to each of the filters. The filters can process the input audio signal CI using the provided coefficients.

The output of the filters can be summed (e.g., added) for the left ear and the right ear of a user, which can be provided to Output Ipsi and Output Contra. In certain embodiments, the surround audio processing unit of FIG. 3*b* can be for one channel, CI. Thus, in these embodiments, there can be a separate processing unit for each channel. For example, in a five channel surround sound system, there may be five separate processing units. In some embodiments, there may be separate portions of the processing unit (such as the Convolution and ER model filters) for each channel, whereas certain portions (such as the LR model filter) may be common to all channels. Each processing unit may provide an output Ipsi and an output Contra. The outputs of each processing unit may be summed together as appropriate, to reproduce the five channels in two ear speakers.

Figure 4:
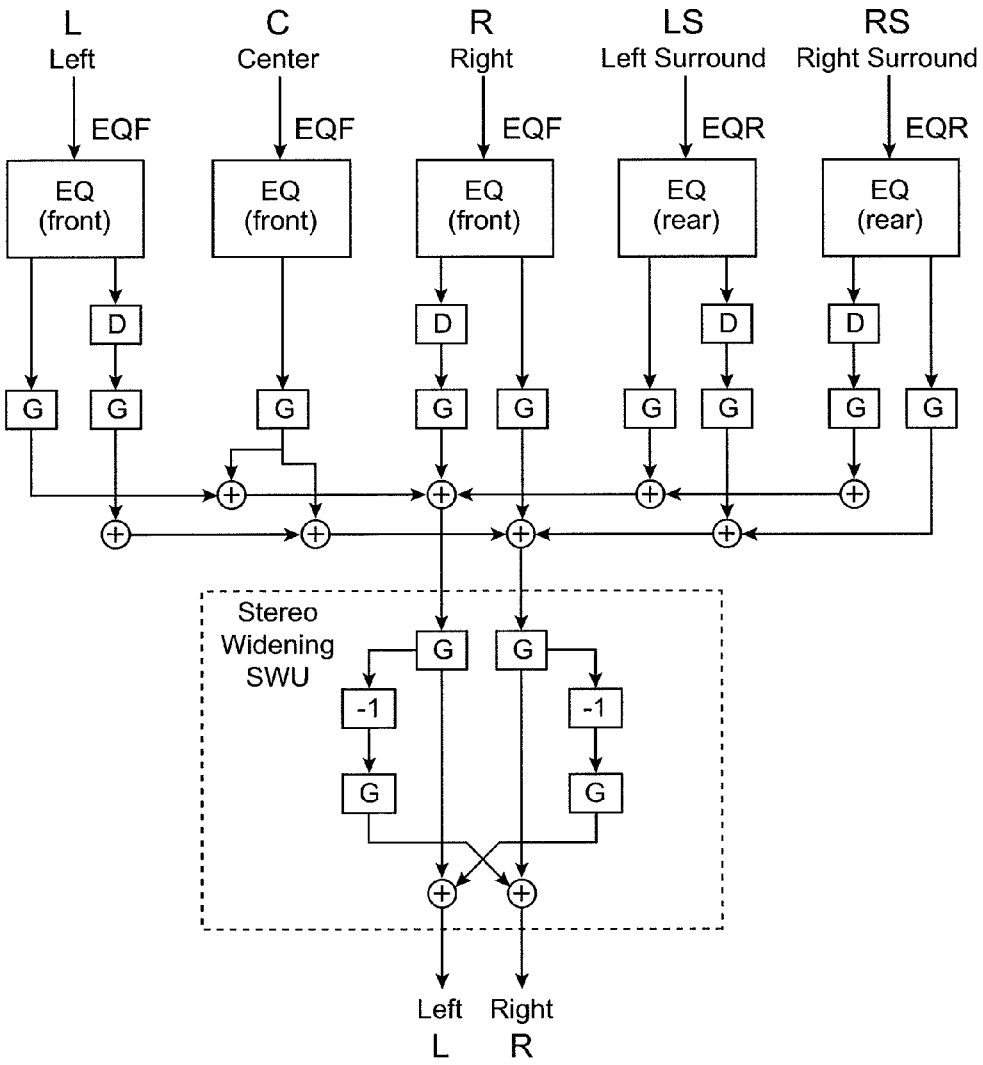
FIG. 4 shows a diagram of a surround audio processing unit and a signal flow of equalization filters according to a second embodiment.

FIG. 4 shows a surround audio processing unit and a signal flow of the equalization filters according to a second embodiment. The input of the equalization processing units EQF, EQR is the left L, the centre C, the right R, the left surround LS and the right surround RS signal. The left, centre and right signal L, C, R are inputted into the equalization unit EQF for the front signals and the left surround and right surround signals are inputted to the equalization unit EQR for the rear. The contra lateral part of the equalization output can be delayed by delay units D.

Each equalizing unit EQF, EQR can have one or two outputs, wherein one output can relate to the Ipsi signal and one can relate to the contra signal. The delay unit and/or a gain unit G can be coupled to the outputs. One output can relate to the left side and one can relate to the right side. The outputs of the left side are summed together and the outputs of the right side are also summed together. The result of these two summations can constitute the left and right signal L, R for the headphone. Optionally, a stereo widening unit SWU can be provided.

In the stereo widening processing unit SWU the output signals of the equalization units EQF, EQR are phase inverted (−1) reduced in their level and added to the opposite channel to widen the sound image.

The outputs of all filters can enter a final gain stage, where the user can balance the equalization units EQFI, EQFC with the convolved signals from the convolution or filter units CU. The bands which are used for the binaural equalization process can be a front-localized band in the 4-5 kHz region and to back-localized bands localized in the 200 and 400 Hz ranges. In some instances, the back-localized bands can be localized in the 800-1500 Hz range.

The method or processing described above can be performed in or by an audio processing apparatus in or for consumer electronic devices. Furthermore, the processing may also be provided for virtual surround home theatre systems, headphone systems for music playback and headphone systems for portable media devices.

By means of the above described processing the user can have room impulses as well as a binaural equalizer. The user will be able to adjust the amount of either signal, i.e. the user will be able to weight the respective signals.

Figure 5:
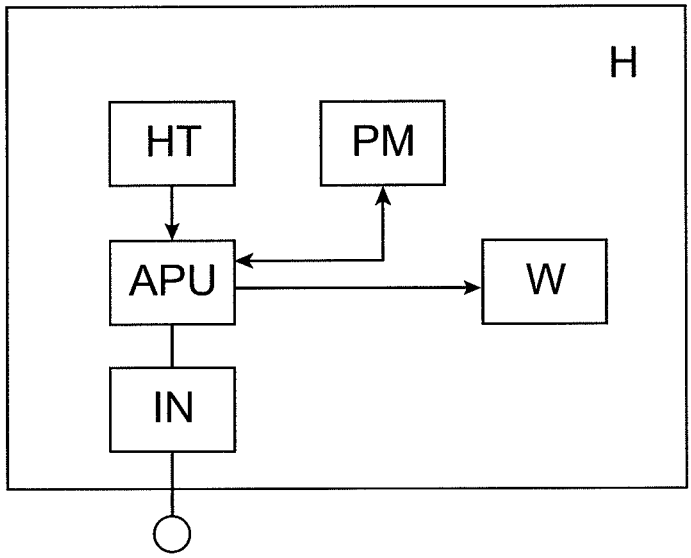
FIG. 5 shows a block diagram of a headphone according to a third embodiment.

FIG. 5 shows a block diagram of a headphone according to a third embodiment. The headphone H comprises a head tracker HT for tracking or determining the position and/or direction of the headphone, an audio processing unit APU for processing the received multi-channel surround audio signal, an input unit IN for receiving the input multi-channel audio signal and an acoustic transducer W coupled to the audio processing unit for reproducing the output of the audio processing unit. Optionally, a parameter memory PM can be provided. The parameter memory PM can serve to store a plurality of sets of filter parameters and/or equalization parameters.

Figure 1:
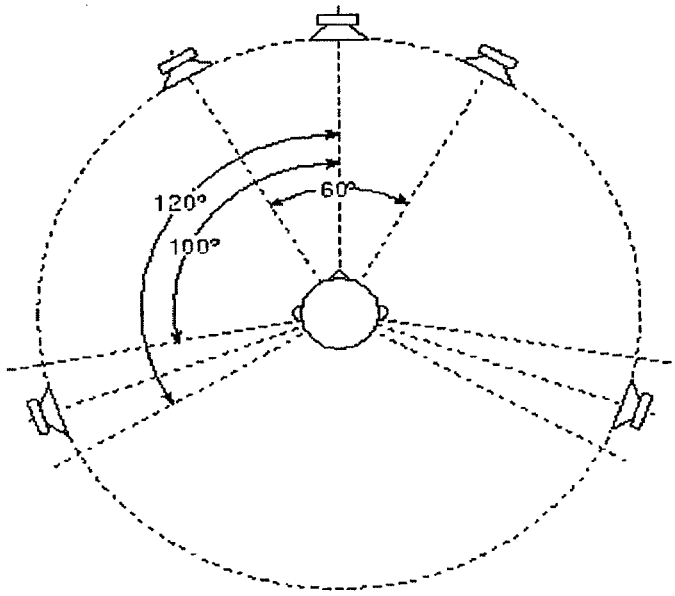
FIG. 1 PRIOR ART
FIG. 1 shows a representation of a typical 5.1 surround sound system with five speakers which are positioned around the listener to give an impression of an acoustic environment.

These sets of parameters can be derived from head-related transfer functions (HRTF), which can be measured as described in FIG. 1. The sets of parameters can for example be determined by shifting an artificial head with two microphones a predetermined angle from its centre position. Such an angle can be for example 10°. When the head has been shifted, a new set of head-related transfer functions HRTF is determined. Thereafter, the artificial head can be shifted again and the head-related transfer functions are determined again. The plurality of head-related transfer functions and/or the derived filter parameters and/or equalization parameters can be stored together with the corresponding angle of the artificial head in the parameter memory.

The head position as determined by the head tracker HT is forwarded to the audio processing unit APU and the audio processing unit APU can extract the corresponding set of filter parameters and equalization parameters which correspond to the detected head position. Thereafter, the audio processing unit APU can perform an audio processing on the received multi-channel surround audio signal in order to provide a left and right signal L, R for the electro-acoustic transducers of the headset.

The audio processing unit according to the third embodiment can be implemented using the filter units CU and/or the equalization units EQFI, EQFC according to the first and second embodiments of FIGS. 3A and 4. Therefore, the convolution units and filter units CU as described in FIG. 3A can be programmable by filter and/or equalization parameters as stored in the parameter memory PM.

According to a fourth embodiment, a convolution and filter units CU and one of the equalization units EQFI, EQFC according to FIG. 3A can be embodied as a single filter, i.e. with two filter units the arrangement of FIG. 3A can be implemented.

According to a fifth embodiment, the audio processing unit as described according to the third embodiment can also be implemented as a dedicated device or be integrated in an audio processing apparatus. In such a case, the information from the head tracker of the headphone can be transmitted to the audio processing unit.

According to a sixth embodiment which can be based on the second embodiment, the programmable delay unit D is provided at each output of the equalization units EQF, EQR. These programmable delay units D can be set as stored in the parameter memory PM.

It should be noted that Ipsi relates to a signal which directly hits a first ear while the signal contra relates to a signal which arrives at the second ear. If in FIG. 1 a signal is coming from the left side, then the left ear will be the Ipsi and the right ear will be contra.

It should be noted that a convolution unit or a pair of convolution units is provided for each of the multi-channel surround audio channels. Furthermore, an equalizing unit or a pair of equalizing units is provided for each of the multi-channel surround audio channels. In the embodiment of FIG. 4, a 5.1 surround system is described with the surround audio signals L, C, R, LS, RS. Accordingly, five equalizing units EQF, EQR are provided.

It should be noted that in FIG. 4 merely the arrangement of the equalizing units is described. For each of the surround audio channels L, C, R, LS, RS, a convolution unit or a pair of convolution units may be provided. The result of the convolution units and the summed output of the equalization units may be summed to obtain the desired output signal.

The delay unit DU2 in FIG. 3 is provided as an audio signal coming from one side and will arrive earlier at the ear facing the signal than at the ear opposite of the first ear. Therefore, a delay may be provided such that the delay of the incoming signal can be compensated (e.g., accounting for the ITD).

It should be noted that the equalizing units are merely serve to improve the quality of the signal. In further embodiments described below, the equalizing units can contribute to localization.

It should be noted that virtual surround solutions according to the prior art make for example use of a binaural filtering to reproduce the auditory spatial and timbre cues that the human brain would receive with a multichannel audio content. According to the prior art, binaurally filtered audio signals are used to deal with the timbre issues. Furthermore, the use of convolution reverb for binaural synthesis, the use of notch and peak filters to simulate head shadowing and the use of binaural recording for binaural synthesis is also known. However, the prior art does not address the use of an equalization used in parallel with a binaural filtering to correct for timbre. The filters used for the binaural filtering focus on reproducing accurate spatial cues and do not specifically care about the timbre produced by this filtering. However, a timbre changed by the binaural filtering is often perceived as altered by the listeners. Therefore, listeners often prefer to listen to a plain stereo down-mix of the multichannel audio content rather than the virtual surround processed version.

The above-described equalizer or equalizing unit can be an equalizer with directional bands or a standard equalizer without directional bands. If the equalizer is implemented without directional bands, the preservation of the timbre competes with the reproduction of spatial cues.

By measuring impulse responses of an audio processing method, it can be detected whether the above-described principles of the invention are implemented.

It may be appreciated that the above embodiments of the invention may be combined with any other embodiment or combination of embodiments of the invention described herein.

Low Order Reflections for Room Modeling

Embodiments of a binaural filtering unit can comprise a room model reproducing the acoustics of a target room as accurately as computing and memory resources allow for. The filtering unit can produce a binaural representation of the early reflections ER that is accurate in terms of time of arrival and frequency content at the listener's ears (such as resources allow for). In certain embodiments, the method can use the combination of a binaural convolution as captured by a binaural room impulse response for the first early reflections and, for the later time section of the early reflections, of an approximation or model. This model can consist of two parts as shown in system 850 of FIG. 6B, a delay line 830 with multiple tap-outs (835*a* . . . 835*n*), and filter system 840. A channel (such as one channel of a seven channel surround recording) can be input to the delay line to produce a plurality of reflection outputs.

Embodiments disclosed herein include methods to reproduce as many geometrically accurate early reflections ER in a room model as resources allow for, using a geometrical simulation of the room. One exemplary method can simulate the geometry of the target room and can further simulate specular reflections on the room walls. Such simulation generates the filter parameters for the binaural filtering unit to use to provide the accurate time of arrival and filtering of the reflections at the centre of the listener's head. The simulation can be accomplished by one of ordinary skill in the acoustical arts without undue experimentation.

Figure 6A:
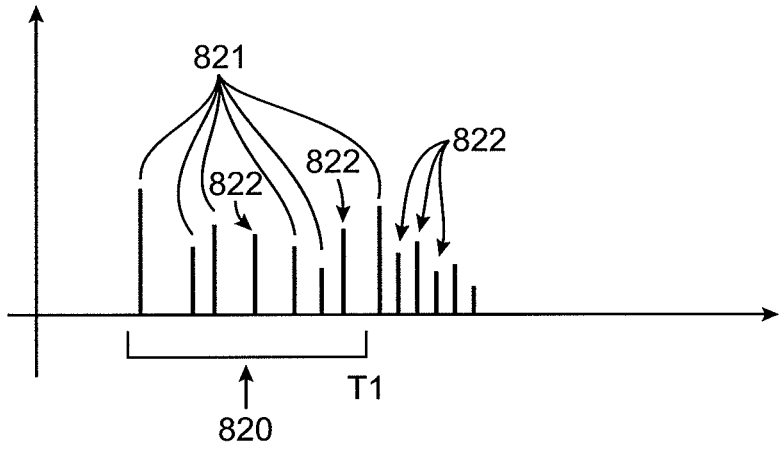
FIG. 6A shows a representation of the effect of reflected sounds.

In certain embodiments, the reflections can be categorized based on the number of bounces of the sound on the wall, commonly referred to as first order reflections, second order reflections, etc. Thus, first order reflections have one bounce, second order reflections have two bounces, and so on. FIG. 6A shows a representation of reflections that can be modeled over time. Both geometrically determined first order reflections 821 and geometrically determined second order reflections 822 are shown. In exemplary embodiments, the reflections to be reproduced can be chosen based on which reflections arrive before a selectable time limit T1. This selectable time limit can be chosen based upon available resources. Thus, all reflected sounds arriving before the selectable time limit 820 may be reproduced, including first order reflections, second order reflections, etc. In certain embodiments, the reflections to be reproduced can be chosen based upon order of arrival, such that any reflection, regardless of number of bounces, may be chosen up to a selectable amount. This selectable amount can be chosen based upon available resources. In certain embodiments, the disclosed method can be used to select the "low order reflections" to model by selecting a given number of reflections based on their time of arrival 820 as opposed to being based on the number of bounces on the walls that each has gone through. In certain embodiments, "low order reflections" can refer to a selectable number of first arriving reflections.

The low order reflections may be chosen by determining the N tap-outs (835*a* through 835*n*) from the delay line 830. The delay of each tap-out may be chosen to be within the selectable time limit. For example, the selectable time limit may comprise 42 ms. In this example, six tap-outs may be chosen with delays of 17, 19, 22, 25, 28, and 31 ms. Other tap-outs may be chosen. Each tap-out can represent a low order reflection within the selectable time limit as shown by reflections 810 in FIG. 8B. Therefore, each tap-out 835*a* through 835*n* can be used to create a representation of a low order reflection during a given period of time. In certain embodiments, the delay of each tap-out may be varied to account for interaural time delay (ITD). That is, the delay of the tap-outs 835*a* through 835*n* in system 850 can vary depending on the direction of the sound being reproduced and also depending on which ear the system 850 is directed to. For example, if each ear of a user has a corresponding system 850, each system can have different tap-out delays to account for the ITD.

In certain embodiments, a five channel surround audio may be used. Each channel can comprise an input. Thus there may be five systems 850 per ear. The system 850 of FIG. 6B may have 6 outputs, for six reflections per channel. In certain implementations this can result in 30 filters (six multiplied by five) per ear. Other amounts of filters can be used, such as for seven channel surround sound. Embodiments of the delay line 830 may have different amounts and timing of tap-outs, to account for different room geometries or other requirements. The output of each of the filters may be summed together per ear, and also can be summed together with any equalized signal and other processed signals (such as late reverberation LR modeling, direct sound modeling, etc.), to produce the audio for each ear of the listener.

It may be appreciated that the above embodiments of the invention may be combined with any other embodiment or combination of embodiments of the invention described herein.

Fixed-Filtering Applied to Early Reflections for Binaural Room Model

Figure 6B:
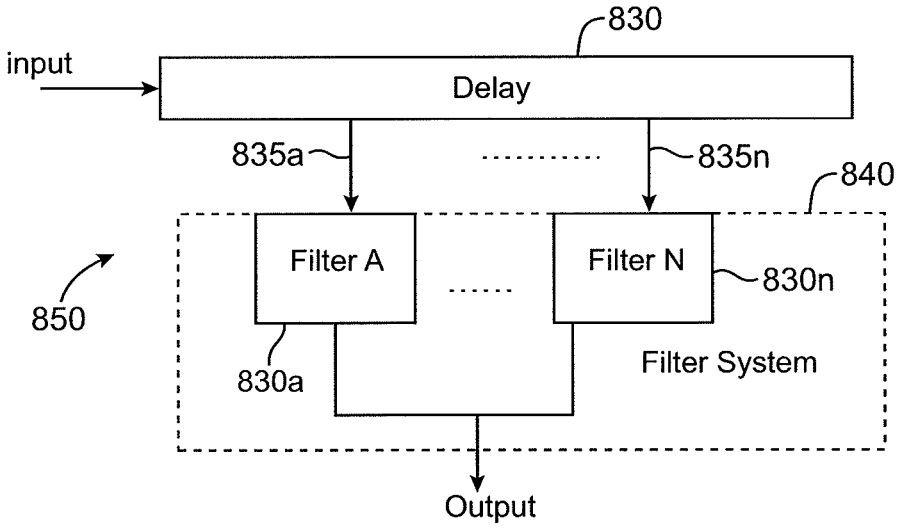
FIG. 6B shows a block diagram of a surround audio processing unit according to an embodiment of the invention.

Each tap-out (835*a* through 835*n*) of FIG. 6B can be filtered to produce spatialized sound. The filter used can be adjusted, based on the information from a head tracker and other optimizing data. In one method, each tap-out can be independently filtered using Head Related Transfer Functions (HRTF). However, as described above, in some embodiments there can be six reflections per input, with five inputs (or more) per ear. This can result in 60 separate tap-outs that could require filtering. Such filtering can be computationally intensive. An embodiment disclosed herein instead can use "fixed filtering." Such fixed filtering can approximate the HRTF functions with less computational power.

Figure 7A:
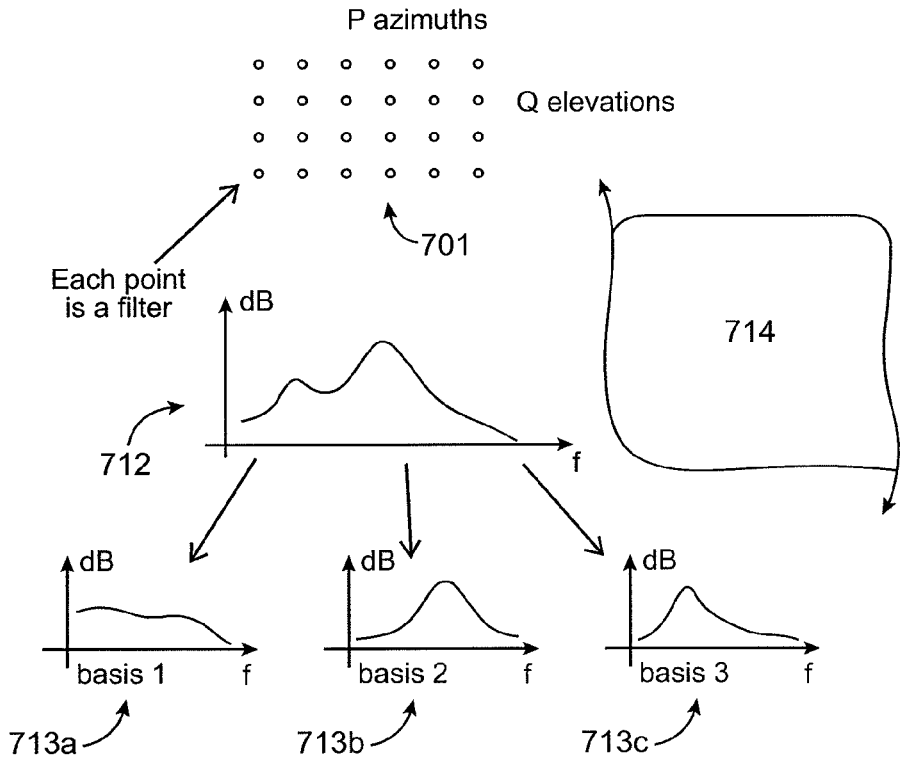
FIG. 7A shows a method of determining fixed filter parameters.

FIG. 7A shows a method of approximating a plurality of HRTF functions using fixed filtering. In exemplary embodiments, a device may store a matrix of HRTF functions 701, such as in the binaural filters database of FIG. 3B. In exemplary embodiments, matrix 701 may comprise as many HRTF filters as required (such as 200 or 300 filters, etc.). These HRTF filters may be "minimum phase filters," that is, excess phase delays have been removed from the filters. Thus, in certain embodiments, interaural time delay (ITD) may not be reproduced by these HRTF filters, but may be reproduced in other systems. Each dot in the matrix 701 can correspond to a particular HRTF filter 712 that is appropriate depending on the location and direction of the reflection to be processed (as shown by the azimuth/elevation coordinates of the matrix 701). Thus, a particular HRTF filter 712 can be chosen based on the specific reflection to be processed, information regarding the user's head position and orientation from a head tracker, etc. For fixed filtering, each HRTF filter 712 in the matrix 701 can be divided into three basis filters 713*a*, 713*b*, and 713*c*. In certain implementations, other amounts of basis filters can be used, such as 2, 4, or more. This can be done using principal component analysis, as is known to those skilled in the art. In certain embodiments, all that differs per HRTF filter in the matrix 701 (organized by Azimuth and Elevation) are the relative amounts of each basis filter. Because of this, a large number of inputs can be processed with a limited number of filters. These three basis filters can be weighted (using gain) and summed together to approximate any HRTF filter 712. Thus, the three basis filter can be seen as building blocks of matrix 701.

Figure 7B:
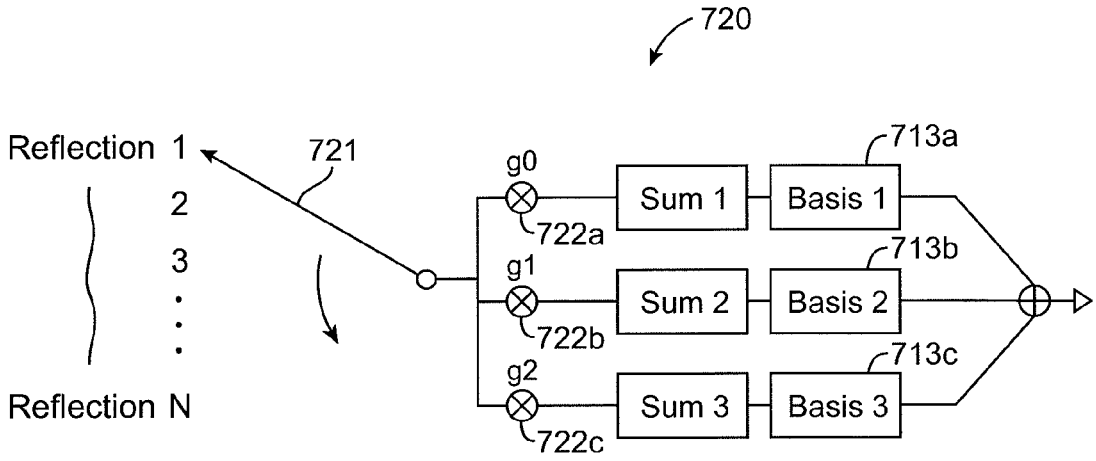
FIG. 7B shows a block diagram of a surround audio processing unit according to an embodiment of the invention.

The basis filters 713*a*, 713*b*, and 713*c* can then be used to process the reflection outputs, in place of filters 830*a* . . . 830*n* of FIG. 6B. FIG. 7B shows an embodiment of filter system 840 using the fixed filter method to spatialize and process each reflection. In certain embodiments, delay line 830 of FIG. 6B can have N reflection outputs (835*a* . . . 835*n*). Each of these reflection outputs can correspond to a reflection in FIG. 7B, with N reflections. Instead of independently filtering each reflection (1 through N), the fixed filter system 720 can connect to each reflection using connection 721. For each reflection, an HRTF filter 712 can be chosen based on source position data, etc. This HRTF filter can in turn be approximated by basis filters 713*a*, 713*b*, and 713*c*. Fixed filter system 720 can first connect to reflection 1. Reflection 1 can be split into two or more (such as three as shown) separate and equal signals, 722*a*, 722*b*, and 722*c*. Each of these signals can then be filtered by an appropriate basis filter and gain, to produce filtered signals. For example, each signal can be multiplied by a specific gain g0, g1, and g2. As each HRTF filter in matrix 701 can be split into the same three basis filters 713*a*, 713*b*, and 713*c*, the gains are what can determine which HRTF filter is being approximated. Thus, gain g0, g1, and g2 can be chosen depending on information from the head tracker, etc. After each output 722*a*, 722*b*, and 722*c* is multiplied by the appropriate gain g0, g1, and g2, it can be stored in a corresponding summing bus 1, 2, or 3.

The fixed filter system can then connect to reflection 2 using connection 721 or other suitable connection, and repeat the process using the appropriate gains g0, g1, and g2. This result can also be stored in summing buses 1, 2, and 3, along with the previously stored reflection 1. This process can be repeated for all reflections. Thus, reflection 1 through reflection N can be split, multiplied by an appropriate gain, and stored in the summing buses. Once all N reflections are so stored, the summing buses can be activated so that the stored reflections are multiplied by the appropriate basis filters 713*a*, 713*b*, and 713*c*. The outputs of the basis filters can then be summed together to provide an output corresponding to section 820 of FIG. 6A. Thus, the output will approximate each reflection having gone through an HRTF filter. As described above, this can be repeated for each channel. The outputs for each channel can then be summed together, along with any other appropriate signals (equalized signals, direct sound signals, late reverberation signals, etc) to provide the audio for an ear of a user. As is known to those skilled in the art, the process can be performed concurrently for the opposing ear.

Embodiments of the fixed filtering disclosed herein can provide a method to produce a binaural representation of the early reflections ER. Exemplary embodiments can create representations to be as accurate in terms of time of arrival (as described with respect to FIG. 6A) and frequency content at the listener's ears as resources allow for. The frequency content for the low order reflections can be approximated by simplified Head-Related Transfer Functions corresponding to the incidence of each low-order reflections. In certain embodiments, this fixed filtering may only be applied to early reflections determined, such as the low order reflections. These reflections can be referred to as virtual sources, as they can be reflections of direct sources. For example, these low order reflections can be provided by the N tap-outs (835*a* through 835*n*) of delay line 830 in FIG. 6B. Therefore, in certain embodiments, only early reflections may be reproduced by the basis filters as described above (i.e., no direct sound). The simplified Head-Related Transfer Functions used in the filters 830*a*-830*n* may also be varied as needed, such as to represent different acoustics or head positions.

It may be appreciated that the above embodiments of the invention may be combined with any other embodiment or combination of embodiments of the invention described herein.

Appropriate Initial Echo Density from Feedback Delay Network

Figure 2:
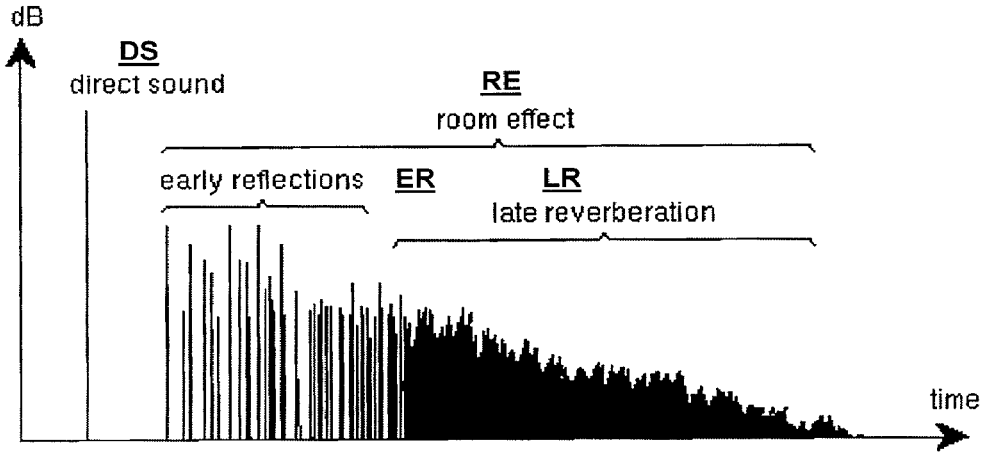
FIG. 2 PRIOR ART
FIG. 2 shows a representation of the effect of direct and indirect sounds.
Figure 8A:
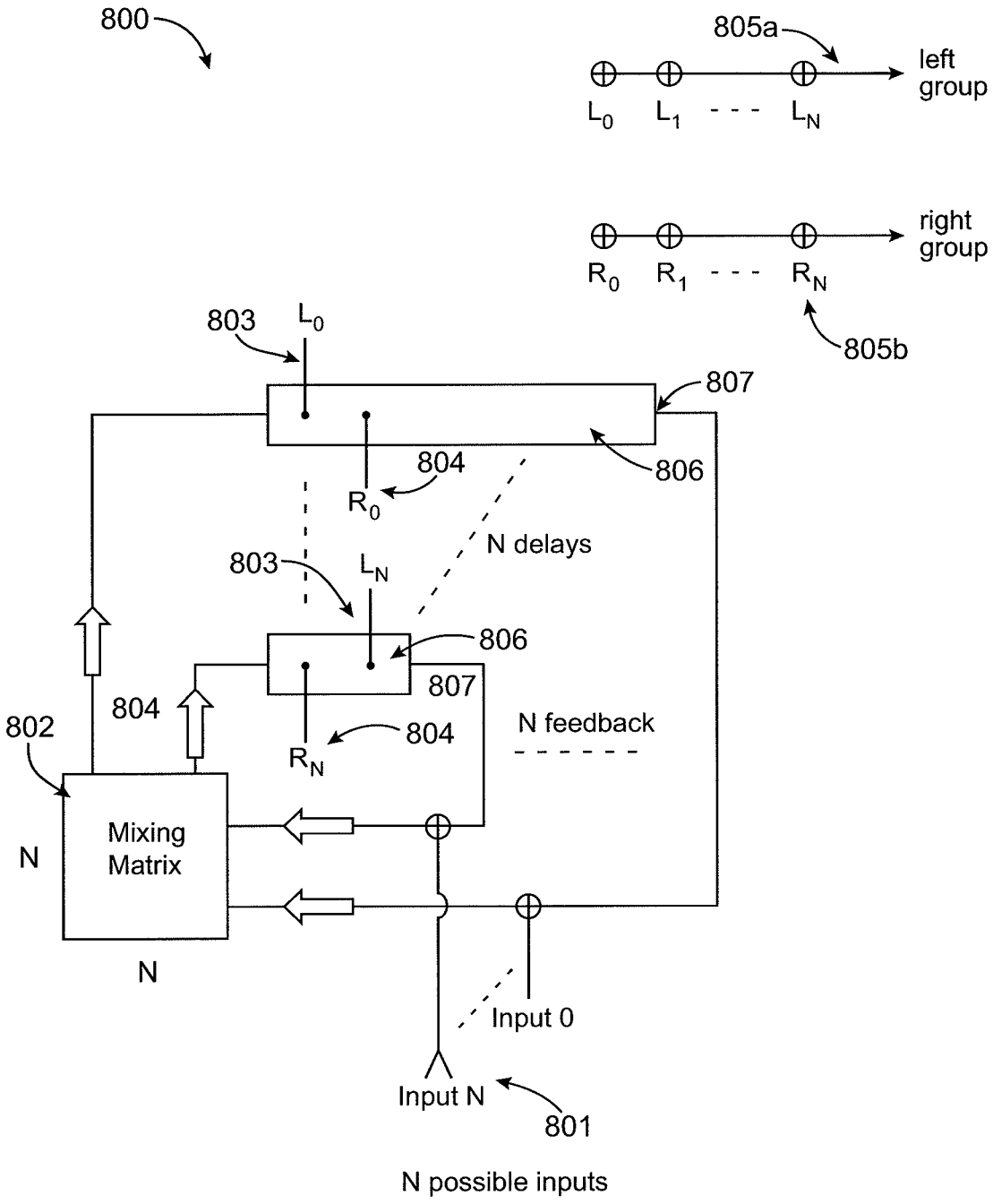
FIG. 8A shows a block diagram of a surround audio processing unit according to an embodiment of the invention.

According to an exemplary embodiment, the filter units CU according to FIG. 3A or 3B can include a Feedback Delay Network (FDN) 800 as shown in FIG. 8A. FDN 800 can have a plurality of tap-outs 803 and 804, and may be used to process the surround audio signals as described below. In exemplary embodiments, FDN 800 can correspond to the LR model in FIG. 3*b*. FDN 800 can be used to simulate the room effect RE shown in FIG. 2, particularly the late reverberation LR. FDN 800 can include a plurality of N inputs 801 (input 0 . . . input N), with each input located before a mixing matrix 802. Each input in the plurality of N inputs 801 can correspond to a channel of the source audio. Thus, for 5 channel surround sound, the FDN 800 can have 5 separate inputs 801. In other implementations, the various channels may be summed together before being input, as a single channel, to the mixing matrix 802.

Figure 8B:
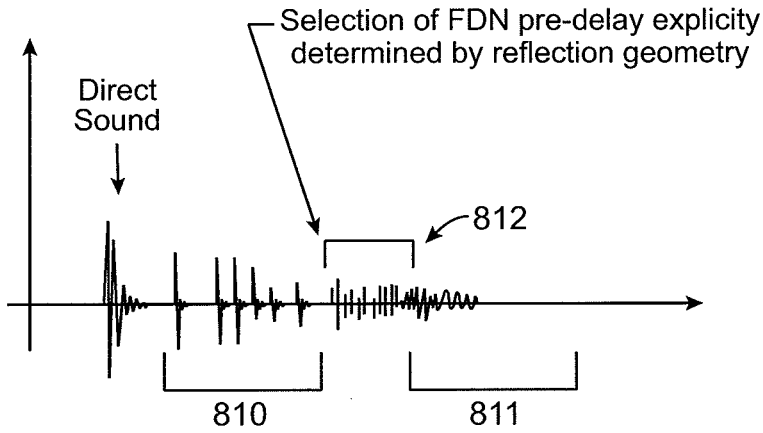
FIG. 8B shows a representation of the effect of direct and indirect sounds.
Figure 8C:
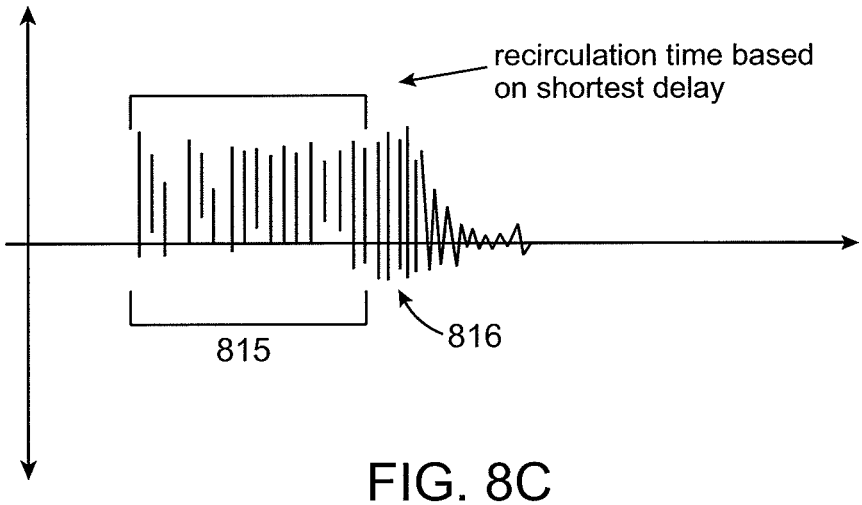
FIG. 8C shows a representation of the effect of late reverberation sounds.

The plurality of inputs 801 is connected to the mixing matrix 802 and an associated feedback loop (loop 0 . . . loop N). In certain embodiments, the mixing matrix 802 can have N inputs 801 by N outputs 804 (such as 12×12). The mixing matrix can take each input 801, and mix the inputs such that each individual output in the outputs 804 contains a mix of all inputs 801. Each output 804 can then feed into a delay line 806. Each delay line 806 can have a left tap-out 803 ($L_0 \ldots L_N$), a right tap-out 804 ($R_0 \ldots R_N$), and a feedback tap-out 807. Thus, each delay line 806 may have three discrete tap-outs. Each tap-out can comprise a delay, which can approximate the late reverberation LR with appropriate echo density. Each feedback tap-out can be added back to the input 801 of the mixing matrix 802. In exemplary embodiments, the right tap-out 804 and the left tap-out 803 may occur before the feedback tap-out 807 for the corresponding delay line (i.e., the delay line tap-out occurs after the left and right tap-outs for each delay line). In certain embodiments, every right tap-out 804 and the left tap-out 803 may also occur before the feedback tap-out for the shortest delay line. Thus, in the example shown in FIG. 8A, the delay line 806 containing tap-outs $L_N$ and $R_N$ may be the shortest delay line in FDN 800. Each right tap-out 804 and left tap-out 803 will therefore occur prior to the feedback tap-out 807 of that delay line. This can create an always increasing echo density 816 in the audio output to the listener, as shown in FIG. 8C.

Embodiments of the FDN 800 can be used in a model of the room effect RE that reproduces with perceptual accuracy the initial echo density of the room effect RE with minimal impact on the spectral coloration of the resulting late reverb. This is achieved by choosing appropriately the number and time index of the tap-outs 803 and 804 as described above along with the length of the delay lines 806. In one aspect, each individual left tap-out $L_0 \ldots L_N$ can each have a different delay. Likewise, each individual right tap-out $R_0 \ldots R_N$ can each have a different delay. The individual delays can be chosen so that the outputs have approximately flat frequencies and are approximately uncorrelated. In certain embodiments, the individual delays can be chosen so that the outputs each have an inverse logarithmic spacing in time so that the echo density increases appropriately as a function of time.

The left tap-outs can be summed to form the left output 805*a*, and the right tap-outs can be summed to form the right output 805*b*. The output of the FDN 800 preferably occurs after the early reflections ER, otherwise the spatialization can be compromised. Embodiments described herein can select the initial output timing of the FDN 800 (or tap-outs) to ensure that the first echoes generated by the FDN 800 arrive in the appropriate time frame. FIG. 8B shows a representation of a filtered audio output. As can be seen in FIG. 8B, selection of the tap-outs 803 and 804 provides an initial FDN 800 output of 812, after the explicitly modeled low-order reflections 810, and before the subsequent recirculation of echoes with monotonically increasing density 811.

The choice for the tap-outs 803 and 804 can also take into account the need for uncorrelated left and right FDN 800 outputs. This can ensure a spacious Room Reproduction. The tap-outs 803 and 804 may also be selected to minimize the perceived spectral coloration, or comb filtering, of the reproduced late reverberation LR. As shown in FIG. 8C, FDN 800 can have approximately appropriate echo spacing 815 at first, and the density can increase with time as the number of recirculations in the FDN 800 increases. This can be seen by the monotonically increasing echo density 816. The choice of tap-outs 803 and 804 can reduce any temporal gap caused by the first recirculation. The placement of the inputs 801 before the mixing matrix can maximize the initial echo density.

Figure 8D:
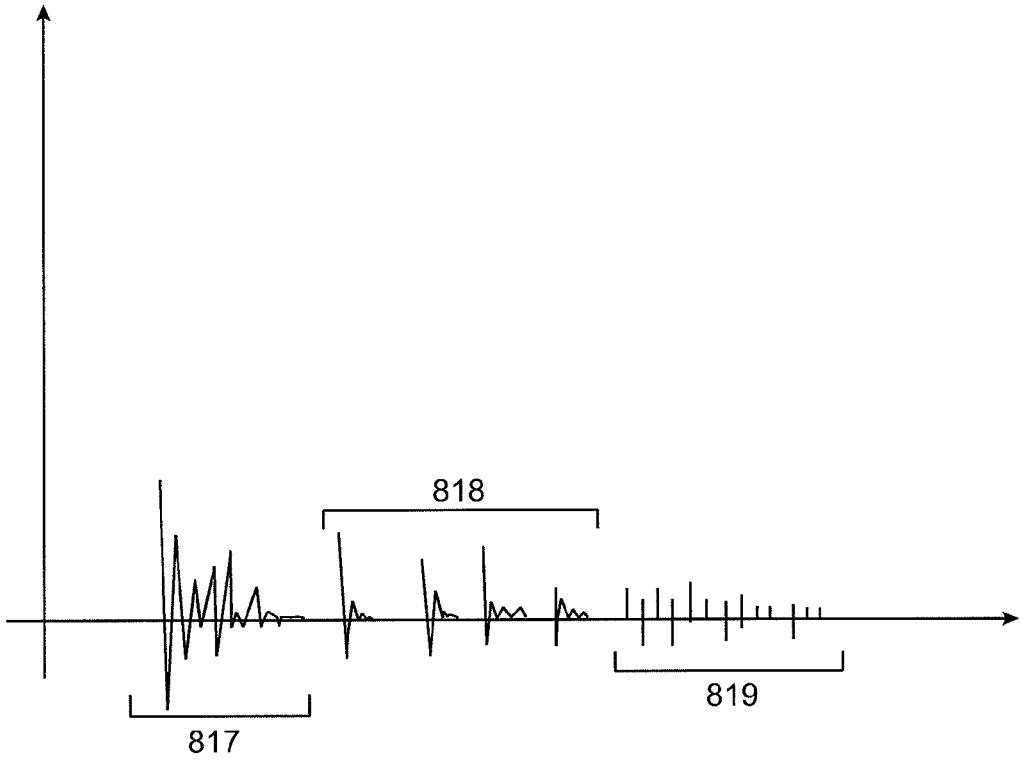
FIG. 8D shows a representation of the effect of direct and indirect sounds.

In exemplary embodiments, the FDN will not overlap with the output of the system 850 shown in FIG. 6B. FIG. 8D depicts the audio output over time of exemplary systems. Section 817 can correspond to a convolution time, which can comprise direct sound and early reflections fitting within a convolution time window allowance. Section 818 can correspond to geometrically modeled early low order reflections with fixed filtering approximation, such as created by the output of the system 850 in FIG. 6B. In certain embodiments, both section 818 and section 817 can represent spatialized outputs. Section 819 can correspond to the output of FDN 800. As can be seen, section 819 does not overlap with section 818. Thus, there is no overlap between the output of FDN 800 with the other processed audio (direct and early reflections). This can be due to the design choices of FDN 800, as described above, which will not impinge on the spatialization of the direct and early reflection outputs.

It may be appreciated that the above embodiments of the invention may be combined with any other embodiment or combination of embodiments of the invention described herein.

Frequency-Based Convolution for Time-Varying Filters

In some embodiments of the invention, the parameters of one or more filters may change in real time. For example, as the head tracker HT determines changes in the position and/or direction of the headphone, the audio processing unit APU extracts the corresponding set of filter parameters and/or equalization parameters and applies them to the appropriate filters. In such embodiments, there may be a need to effect the changes in parameters with the least impact on the sound quality. We present in this section an overlap-add method can be used to smooth the transition between the different parameters. This method also allows for a more efficient real-time implementation of a Room Reproduction.

Figure 9A:
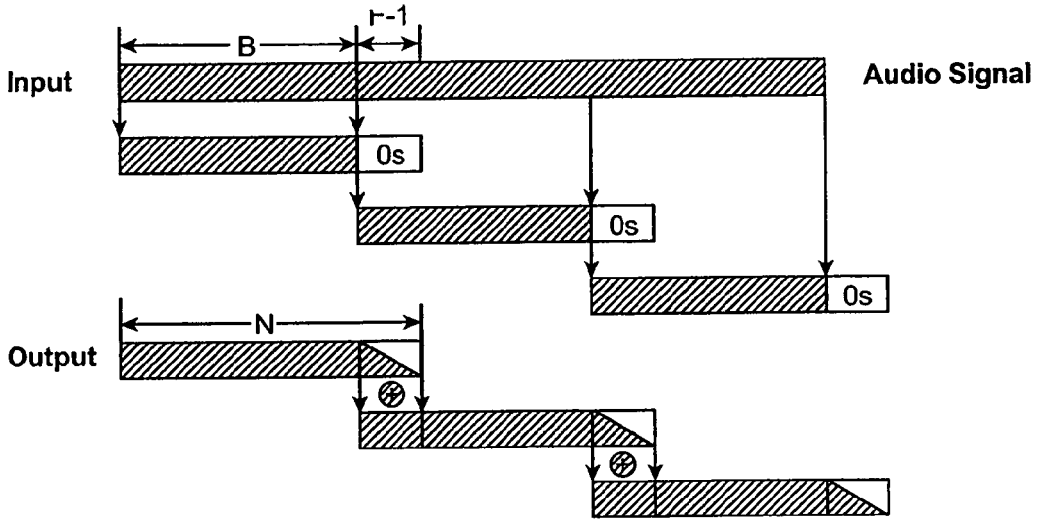
FIG. 9A shows a representation of an overlap-add method for smoothing time-varying parameters convolved in the frequency range according to an embodiment.

FIG. 9A shows a representation of an overlap-add (OLA) method for smoothing time-varying parameters convolved in the frequency range according to a embodiment After extracting the set of filter and/or equalization parameters for a given position and/or direction of the headphone, the audio processing unit APU transforms the parameters into the frequency domain. The input audio signal AS is segmented into a series of blocks with a length B that are zero padded. The zero padded portion of the block has a length one less than the filter (F−1). Additional zeros are added if necessary so that the length of the Fast Fourier Transform FFT is a power of two. The blocks are transformed into the frequency domain and multiplied with the transformed filter and/or equalization parameters. The processed blocks are then transformed back to the time domain. The tail due to the convolution is now within the zero padded portion of the block and gets added with the next block to form the output signals. Note that there is no additional latency when using this method.

Figure 9B:
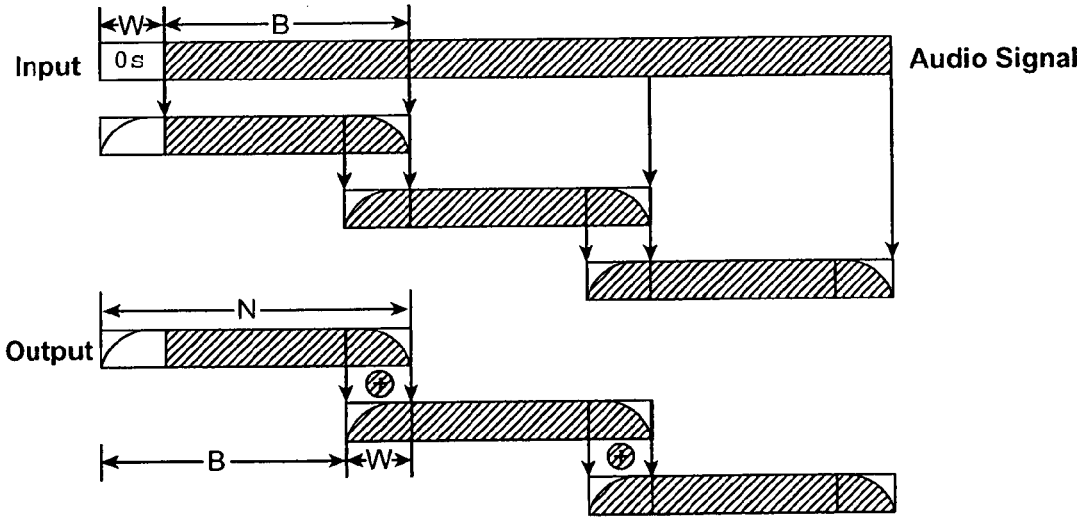
FIG. 9B shows a representation of a window overlap-add method for smoothing time-varying parameters convolved in the frequency range according to an embodiment.

FIG. 9B shows a representation of a window overlap-add (WOLA) method for smoothing time-varying parameters convolved in the frequency range according to an embodiment. The audio processing unit APU extracts a set of filter and/or equalization parameters for a given position and/or direction of the headphone and transforms the parameters into the frequency domain. The input audio signal AS is segmented into a series of blocks. The signal is delayed by a window of length W. For each block, B+W samples are read from the input and windowed, and a zero padded portion of length W is applied to both ends. The blocks are transformed into the frequency domain and multiplied with the transformed filter and/or equalization parameters. The processed blocks are then transformed back to the time domain and the padded portions gets added with the next block to form the output signals. If the window follows the Constant Window Overlap Add (COLA) constraint, then the blocks will sum to one and the signal will be reconstructed. Note that there is a latency of W added to the output. Also note that if the signal is convolved with a filter, then circular convolution effects will appear.

Figure 9C:
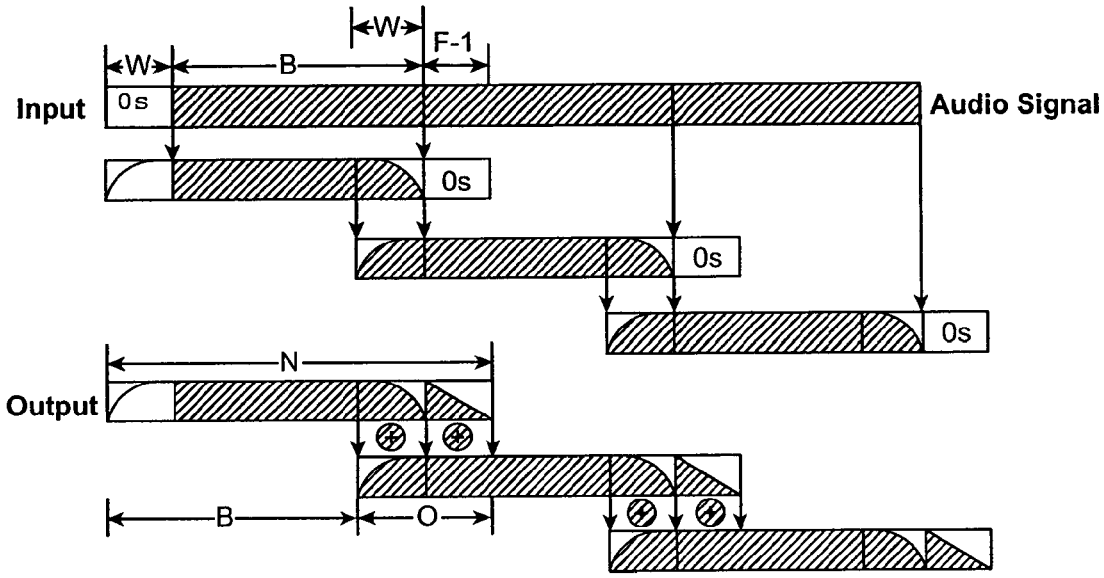
FIG. 9C shows a representation of a modified window overlap-add method for smoothing time-varying parameters convolved in the frequency range according to an embodiment.

FIG. 9C shows a representation of a modified window overlap-add method for smoothing time-varying parameters convolved in the frequency range according to an embodiment. This method adds additional zeros to leave room for the tail of the convolution and to avoid circular convolution effects. The audio processing unit APU extracts a set of filter and/or equalization parameters for a given position and/or direction of the headphone and transforms the parameters into the frequency domain. The input audio signal AS is segmented into a series of blocks. The signal is delayed by a window of length W. For each block, B+W samples are read from the input and windowed with at least F−1 samples being zero. The blocks are transformed into the frequency domain and multiplied with the transformed filter and/or equalization parameters. The processed blocks are then transformed back to the time domain. The overlap regions of length W+F−1 are added to form the output signals. Note that this causes an additional delay of W to the processing.

According to an embodiment, the window length and/or the block length may be variable from block to block to smooth the time-varying parameters according to the methods illustrated in FIGS. 9A-9C.

According to an embodiment, the filter unit or the equalizing unit may acquire the set of filter and equalization parameters for a given position and/or direction and perform the signal process according to the methods illustrated in FIGS. 9A-9C.

FIGS. 9D-9H show pseudo code used in a modified window overlap-add method for smoothing time-varying filters convolved in the frequency range according to an embodiment. FIG. 9D provides a list of variables used in the modified window overlap-add method. FIG. 9E provides pseudo code for the window length, FFT length, and length of the overlapping portion of the blocks. FIG. 9F provides the pseudo code for the transformation of the blocks into the frequency range. FIG. 9G provides the pseudo code for the transformation of the filter parameters. FIG. 9H provides the pseudo code for transforming the processed blocks to the time domain.

It may be appreciated that the above embodiments of the invention may be combined with any other embodiment or combination of embodiments of the invention described herein.

Modified Head-Related Transfer Functions to Compensate Timbral Coloration

In the various embodiments disclosed herein, HRTFs may be used which have been modified to compensate for timbral coloration, such as to allow for an adjustable degree of timbral coloration and correction therefore. These modified HRTFs may be used in the above-described binaural filter units and binaurally filtering processes, without the need to use the equalizing units and equalizing processes. However, the modified HRTFs disclosed below may be used in the above-described equalizing units and equalizing processes, alone or in combination with their use of the above-described binaural filter units and binaurally filtering processes.

As is known in the art, an HRTF may be expressed as a time domain form or a frequency domain form. Each form may be converted to the other form by an appropriate Fourier transform or inverse Fourier transform. In each form, the HRTF is a function of the position of the source, which may be expressed as a function of azimuth angle (e.g., the angle in the horizontal plane), elevation angle, and radial distance. Simple HRTFs may use just the azimuth angle. Typically, the left and right HRTFs are measured and specified for a plurality of discrete source angles, and values for the HRTFs are interpolated for the other angles. The generation and structure of the modified HRTFs are best illustrated in the frequency domain form. For the sake of simplicity, and without loss of generality, we will use HRTFs that specify the source location with just the azimuth angle (e.g., simple HRTFs) with the understanding the generation of the modified forms can be readily extended to HRTFs that use elevation angle and radial distance to specify the location of the source.

In one exemplary embodiment, a set of modified HRTFs for left and right ears is generated from an initial set, which may be obtained from a library or directly measured in a anechoic chamber. (The HRTFs in the available libraries are also derived from measurements.) The values at one or more azimuth angles of the initial set of HRTFs are replaced with modified values to generate the modified HRTF. The modified values for each such azimuth angle may be generated as follows. The spectral envelope for a plurality k of audio frequency bands is generated. The spectral envelope may be generated as the root-mean-square (RMS) sum of the left and right HRTFs in each frequency band for the given azimuth angle, and may be mathematically denoted as:

$$\text{RMSSpectrum}(k)=sqrt(\text{HRTFL}(k)^2+\text{HRTFR}(k)^2); \quad \text{(F1)}$$

where HRTFL denotes the HRTF for the left ear, HRTFR denotes the HRTF for the right ear, k is the index for the frequency bands, and "sqrt" denotes the square root function. Each frequency band k may be very narrow and cover one frequency value, or may cover several frequency values (currently one frequency value per band is considered best). A timbrally neutral, or "Flat", set of HRTFs may then be generated from the RMSSpectrum(k) values as follows:

$$\text{FlatHRTFL}(k)=\text{HRTFL}(k)/\text{RMSSpectrum}(k);$$

$$\text{FlatHRTFR}(k)=\text{HRTFR}(k)/\text{RMSSpectrum}(k); \quad \text{(F2)}$$

The RMS values of these FlatHRTFs are equal to 1 in each of the frequency bands k. Since the RMS values are representative of the energy in the bands, their values of unity indicate the lack of perceived coloration. However, the right and left values at each frequency band and source angle are different, and this difference generates the externalization effects.

A particular degree of coloration may be adjusted by generating modified HRTF values in a mathematical form equivalent to:

$$\text{NewHRTFL}(k)=\text{FlatHRTFL}(k)*(\text{RMSSpectrum}(k))^{C};$$

$$\text{NewHRTFR}(k)=\text{FlatHRTFR}(k)*(\text{RMSSpectrum}(k))^{C}; \quad \text{(F3)}$$

where parameter C is typically in the range of [0,1], and it specifies the amount of coloration. A mathematically equivalent form of form (F3) is as follows:

$$\text{NewHRTFL}(k)=\text{HRTFL}(k)*(\text{RMSSpectrum}(k))^{(C-1)};$$

$$\text{NewHRTFR}(k)=\text{HRTFR}(k)*(\text{RMSSpectrum}(k))^{(C-1)}; \quad \text{(F4)}$$

A value of C=1 will recreate the original HRTFs. It is conceivable that C>1 could be used to enhance the features of an HRTF. The typical trade-off for reduced coloration is that externalization reduces for C<1 and, for small values, localization precision is also reduced. Smoothing of the reapplied RMSSpectrum in Equations (F3) may be done, and may be helpful.

The modified HRTFs may be generated for only a few source angles, such as those going from the front left speaker to the front right speaker, or may be generated for all source angles.

An important frequency band for distinguishing localization effects lies from 2 kHz to 8 kHz. In this band, most normalized sets of HRTFs have dynamic ranges in their spectral envelopes of more than 10 dB over a major span of the source azimuth angle (e.g., over more than 180 degrees). The dynamic ranges of unnormalized sets of HRTFs are the same or greater.

Figure 11A:
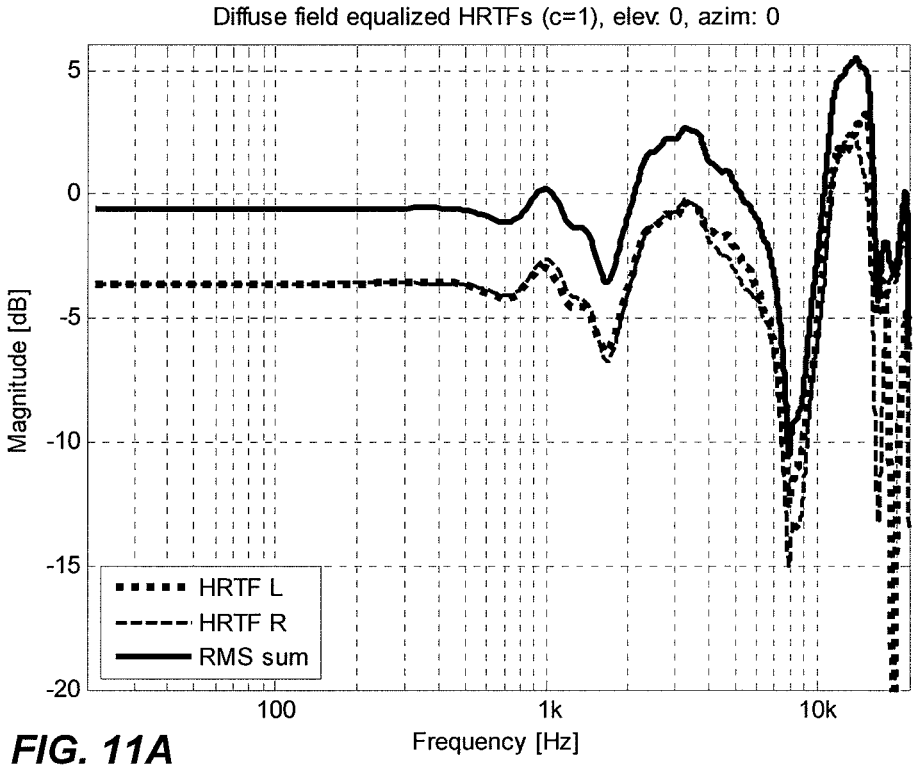
FIG. 11A shows an exemplary normalized set of HRTFs for a source azimuth angle of zero degrees.

FIG. 11A pertains to a normalized set of HRTFs than may be commonly used in the prior art for a source azimuth angle of 0 degrees (source at that median plane, which is the plane of the human model from which the left and right HRTFs were measured). Three quantities are shown: the magnitude of the left HRTF ("HRTF L"), the magnitude of the right HRTF ("HRTF R"), and the spectral envelope ("RMS sum"). The magnitudes of the left and right HRTFs are substantially identical, as would be expected for a source at the median plane. As can be seen, the spectral envelope has a dynamic range of 13 dB (+3 dB to −10 dB) in amplitude over the frequency range of 2 kHz to 8 kHz (C=1). (As indicated above, the spectral envelope is a measure of the combined magnitudes of the left and right HRTFs over a given frequency range for a given source angle; and as is known in the art, the dynamic range is a measure of the difference between the highest point and the lowest point in the range.) The dynamic ranges at some source angles, such as at 120 degrees from the median plane, can have values substantially larger than this, while some source angles, such as at 30 degrees from the median plane, can have values that are less.

Figure 11B:
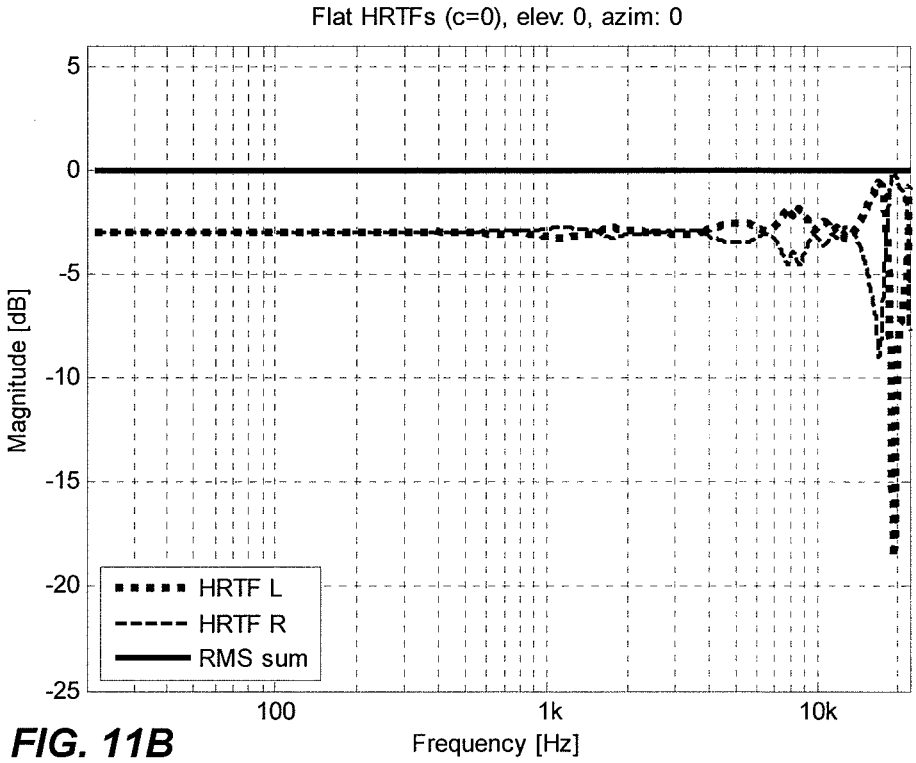
FIGS. 11B and 11C show exemplary modified sets of HRTFs for a source azimuth angle of zero degrees according to an embodiment of the invention.
Figure 11C:
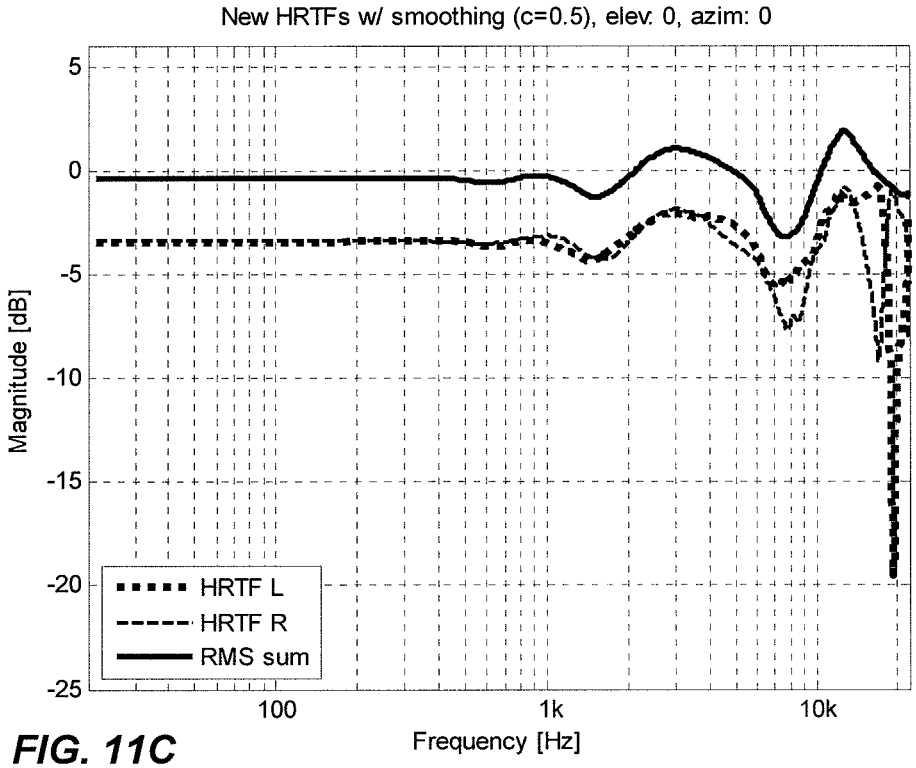

FIG. 11B shows a modified version of the HRTF set according to the invention, where the spectral envelope has been completely flattened (C=0). FIG. 11C shows a modified version that has been partially flattened according to the invention with C=0.5. The spectral envelope has a dynamic range of 4.5 dB (+1 dB to −3.5 dB) in amplitude over the frequency range of 2 kHz to 8 kHz. Using a value of C less than 0.5, such as C=0.3, will further reduce this dynamic range. A general range of C can span from 0.1 to 0.9. A typical range of C spans from 0.2 to 0.8, and more typically from 0.3 to 0.7.

Figure 12A:
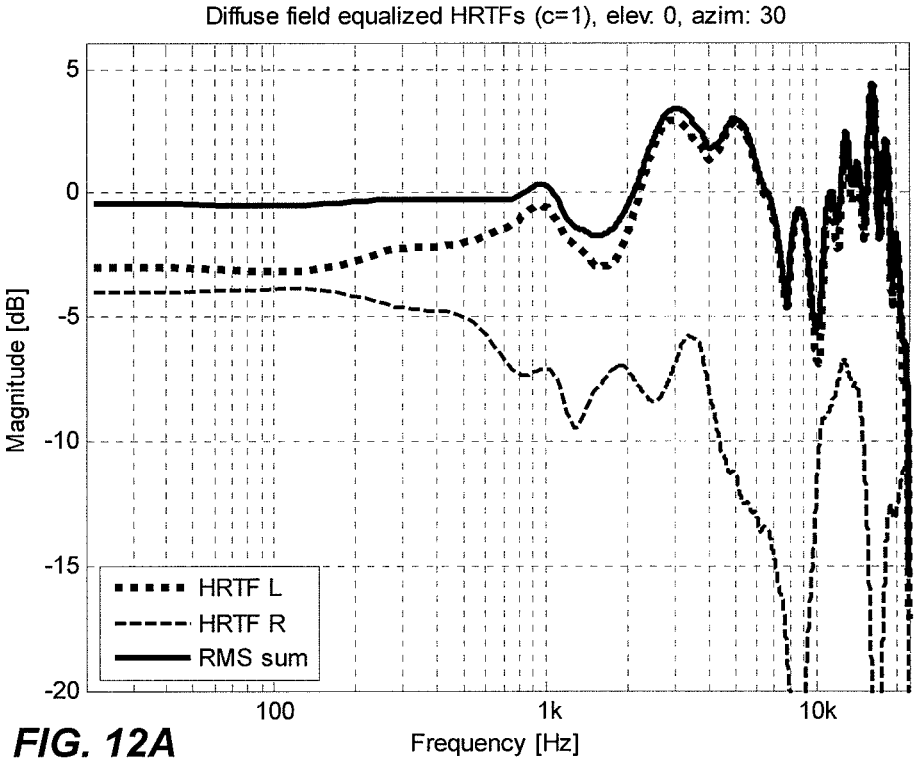
FIG. 12A shows an exemplary normalized set of HRTFs for a source azimuth angle of 30 degrees.
Figure 12B:
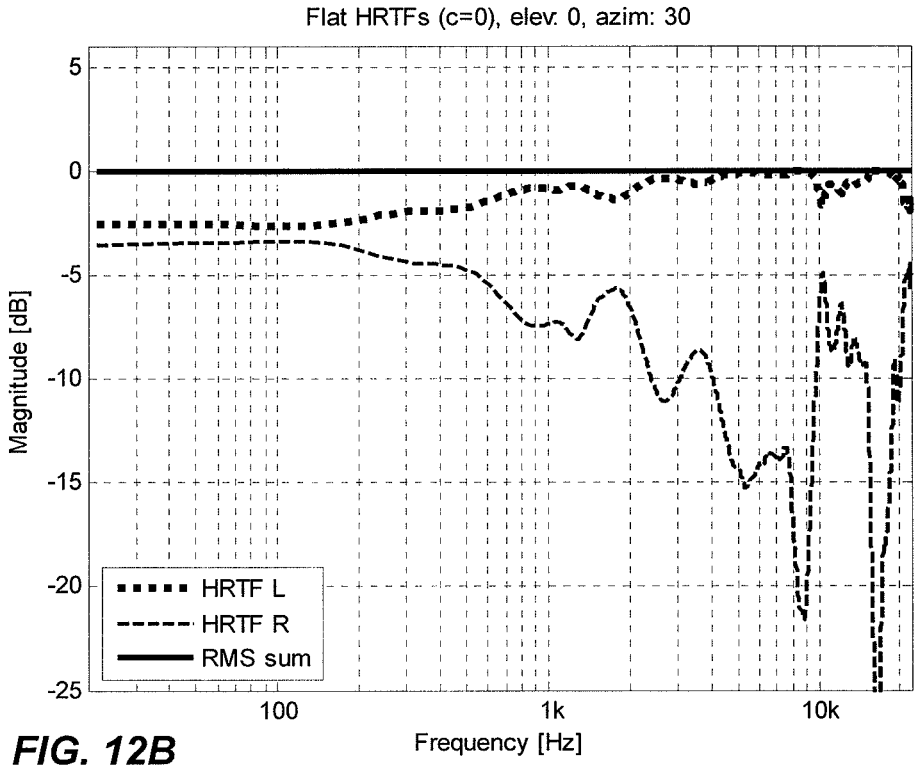
FIGS. 12B and 12C show exemplary modified sets of HRTFs for a source azimuth angle of 30 degrees according to an embodiment of the invention.
Figure 12C:
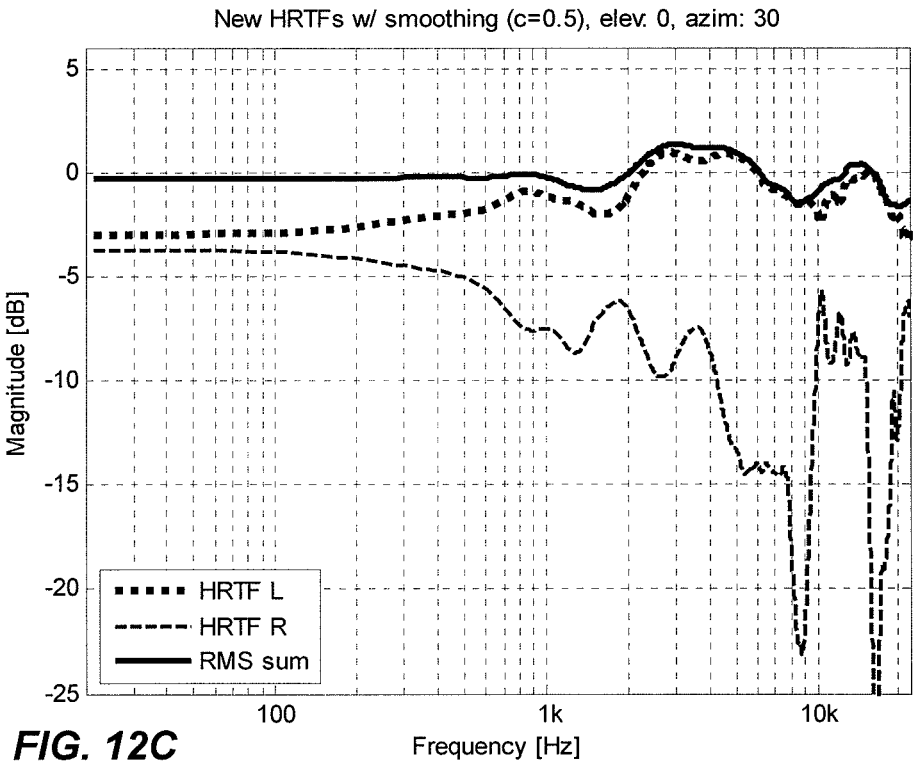

FIG. 12A shows that normalized set of HRTFs introduced in FIG. 11 for a source azimuth angle of 30 degrees to the left of the median plane. The same three quantities are shown: the magnitude of the left HRTF ("HRTF L"), the magnitude of the right HRTF ("HRTF R"), and the spectral envelope ("RMS sum"). The magnitude of the left HRTF is substantially larger than that of the right HRTF, as would be expected for a source located to the left of the listener. As can be seen, the spectral envelope has a dynamic range of 8 dB (+3.5 dB to −4.5 dB) in amplitude over the frequency range of 2 kHz to 8 kHz (C=1). FIG. 12B shows a modified version of the HRTF set according to the invention, where the spectral envelope has been completely flattened (C=0). FIG. 12C shows a modified version that has been partially flattened according to the invention with C=0.5. The spectral envelope has a dynamic range of 3 dB (+1.5 dB to −1.5 dB) in amplitude over the frequency range of 2 kHz to 8 kHz. Using a value of C less than 0.5, such as C=0.3, will further reduce this dynamic range.

Thus, sets of HRTFs modified according to the present invention can have spectral envelopes in the audio frequency range of 2 kHz to 8 kHz that are equal to or less than 10 dB over a majority of the span of the source azimuth angle (e.g., over more than 180 degrees), and more typically equal to or less than 6 dB.

In considering a pair of angles disposed asymmetrically about the median plane, such as the above source angles of 0 and 30 degrees, the dynamic ranges in the spectral envelopes can both be less than 10 dB in the audio frequency range of 2 kHz to 8 kHz, with at least one of them being less than 6 dB. With lower values of C, such as between C=0.3 to C=0.5, the dynamic ranges in both the spectral envelopes can both be less than 6 dB in the audio frequency range of 2 kHz to 8 kHz, with at least one of them being less than 4 dB, or less than 3 dB.

The modified HRTFs (NewHRTFL and NewHRTFR) may be generated by corresponding modifications of the time-domain forms. Accordingly, it may be appreciated that a set of modified HRTFs may be generated by modifying the set of original HRTFs such that the associated spectral envelope becomes more flat across the frequency domain, and in further embodiments, becomes closer to unity across the frequency domain.

In further embodiments of the above, the modified HRTFs may be further modified to reduce comb effects. Such effects occur when a substantially monoaural signal is filtered with HRTFs that are symmetrical relative to the median plane, such as with simulated front left and right speakers (which occurs frequently in virtual surround sound systems). In essence, the left and right signals substantially cancel one another to create notches of reduced amplitude at certain audio frequencies at each ear. The further modification may include "anti-comb" processing of the modified Head-Related Transfer Functions to counter this effect. In a first "anti-comb" process, slight notches are created in the contralateral HRTF at the frequencies where the amplitude sum of the left and right HRTFs (with ITD) would normally produce a notch of the comb. The slight notches in the contralateral HRTFs reduce the notches in the amplitude sums received by the ears. The processing may be accomplished by multiplying each NewHRTF for each source angle with a comb function having the slight notches. The processing modifies ILDs and should be used with slight notches in order to not introduce significant localization errors. In a second "anti-comb" process the RMSSpectrum is partially amplified or attenuated inversely proportional to the amplitude sum of the left and right HRTFs (with ITD). This process is especially effective in reducing the bass boost that often follows from virtual stereo reproduction since low frequencies in recordings tend to be substantially pretty monoaural. This process does not modify the ILDs, but should be used in moderation. Both "anti-comb" processes, particularly the second one, add coloration to a single source hard panned to any single virtual channel, so there are trade-offs between making typical stereo sound better and making special cases sound worse.

It may be appreciated that this embodiment of the invention may be combined with any other embodiment or combination of embodiments of the invention described herein.

Angular Warping of the Head Tracking Signal to Stabilize the Source Images

As described above with reference to FIG. 5, a head tracker HT may be incorporated into a headset, and the head position signal therefrom may be used by an audio processing unit to compensate for the movement of the head and thereby maintain the illusion of a number of immobile virtual sound sources. As indicated above, this can be done by switching or interpolating the applied filters and/or equalizers as a function of the listener's head movements. In one embodiment, this can be done by determining the azimuth angular movement from the head tracker HT data, and by effectively mathematically moving the virtual sound sources by an azimuth angle of the opposite value (e.g., if the head moves by $\Delta\theta$, the sources are moved by $-\Delta\theta$). This mathematical movement can be achieved by rotating the angle that is used to select filter data from a HRTF for a particular source, or by shifting the source angles in the parameter tables/databases of the filters.

Figure 10A:
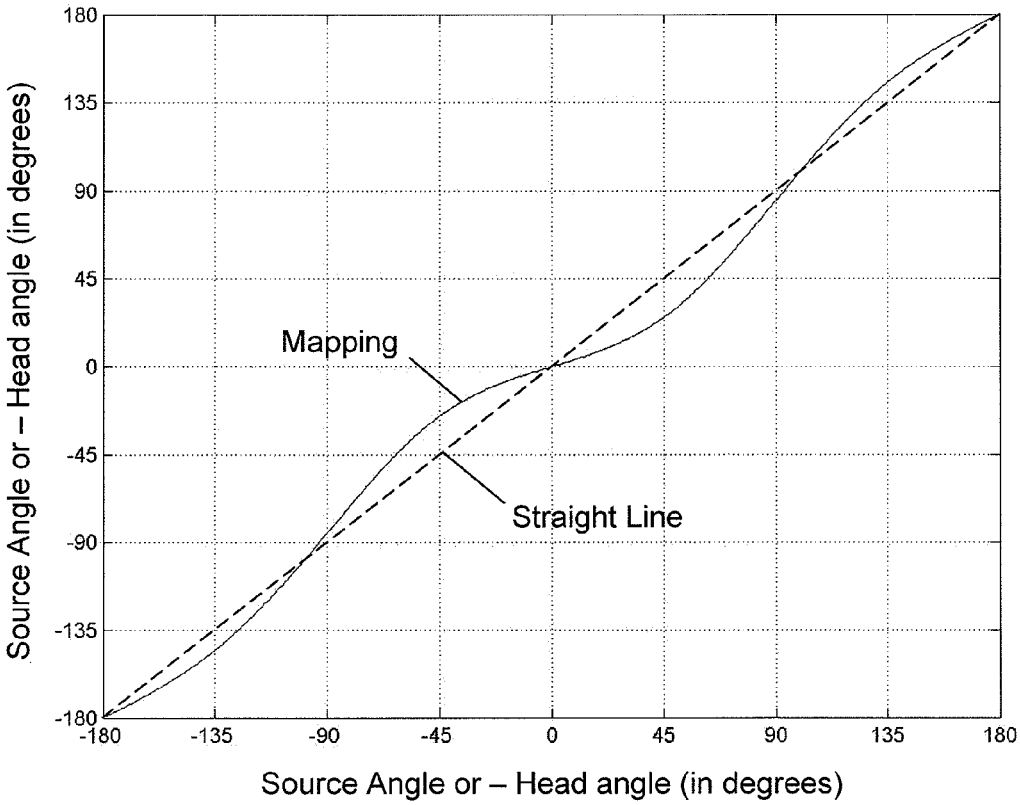
FIG. 10A shows an exemplary mapping function that relates the modified source angle (or head angle) to an input angle according to an embodiment of the invention.

However, a given set of HRTFs does not precisely fit each individual human user, and there are always slight variations between what a given HRTF set provides and what best suits a particular human individual. As such, the above-described straightforward compensation may lead to varying degrees of error in the perceived angular localization for a particular individual. Within the context of head-tracked binaural audio, such varying errors may lead to a perceived movement of the source as a function of head-movements. According to another embodiment of the present invention, the perceived movement of the sources can be compensated for by mapping the current desired source angle (or current measured head angle) to a modified source angle (or modified head angle) that yields a perception closest to the desired direction. The mapping function can be determined from angular localization errors for each direction within the tracked range if these errors are known. As another approach, controls may be provided to the user to allow adjustment to the mapping function so as to minimize the perceived motion of the sources. FIG. 10A shows an exemplary mapping function that relates the modified source angle (or negative of the modified head angle) to the current desired source angle (or negative of the measured head angle). Also shown in FIG. 10A is a dashed straight line for the case where the modified angle would be equal to the input angle (desired angle). As can be seen by comparing the exemplary mapping to the straight line, there is some compression of the modified angle (e.g., slope less than 1) near a source angle of zero and 180 degrees (e.g., front and back). In other instances, there may be some expansion of the modified angle (e.g., slope greater than 1) near a source angle of zero and 180 degrees (e.g., front and back).

Any mapping function known to those with skill in the relevant arts can be used. In one embodiment of the present invention, the mapping function is implemented as a parametrizable cubic spline that can be easily adjusted for a given positional filters database or even for an individual listener. The mapping can be implemented by a set of computer instructions embodied on a tangible computer readable medium that direct a processor in the audio processor unit to generate the modified signal from the input signal and the mapping function. The set of instructions may include further instructions that direct the processor to receive commands from a user to modify the form of the mapping function. The processor may then control the processing of the input surround audio signals by the above-described filters in relation to the modified angle signal.

Figure 10B:
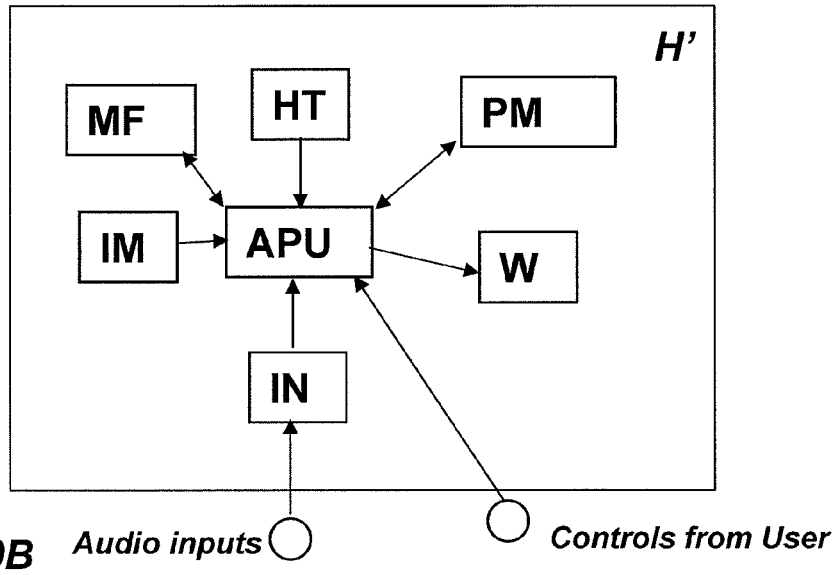
FIG. 10B shows another exemplary headset (headphone) according to an embodiment of the present invention.

An embodiment of an exemplary audio processing unit is shown by way of an augmented headset H' in FIG. 10B that is similar to headset H show in FIG. 5. In FIGS. 5 and 10B, block W represents the headphone's speakers, APU represents the audio processor, PM represents the parameters memory, HT represents the head tracker, and IN the input receiving unit to receive the surround sound signals. In FIG. 10B, IM represents the tangible computer readable memory for storing instructions that direct the audio processor unit APU, including instructions that direct the APU to generate any of the filtering topologies disclosed herein, and to generate the modified angle signal. Block MF is a tangible computer readable memory that stores a representation of the mapping function. The APU can receive control signals from the user directing changes in the mapping, which is indicated by the second input and control line to the APU. All of the memories may be separate or combined into a single memory unit, or two or three memory units.

It may be appreciated that this embodiment of the invention may be combined with any other embodiment or combination of embodiments of the invention described herein.

The terms and expressions which have been employed herein are used as terms of description and not of limitation, and there is no intention in the use of such terms and expressions of excluding equivalents of the features shown and described, it being recognized that various modifications are possible within the scope of the invention claimed. Moreover, one or more features of one or more embodiments of the invention may be combined with one or more features of other embodiments of the invention without departing from the scope of the invention. While the present invention has been particularly described with respect to the illustrated embodiments, it will be appreciated that various alterations, modifications, adaptations, and equivalent arrangements may be made based on the present disclosure, and are intended to be within the scope of the invention and the appended claims.

The invention claimed is:

1. A method for providing surround audio signals, comprising the steps of:

receiving input surround audio signals, the input surround audio signals including a plurality of source input channels;

binaurally filtering the input surround audio signals by at least one filter unit to produce binaurally filtered signals, wherein the at least one filter unit includes a feedback delay network including a plurality of tap-outs, wherein the feedback delay network includes a mixing matrix having a plurality of mixing matrix input channels, and wherein the plurality of the source input channels is coupled to the mixing matrix input channels;

processing the input surround audio signals by the feedback delay network;

performing a binaural equalizing processing on the input surround audio signals by at least one equalization unit to produce equalized signals; and combining the binaurally filtered signals and the equalized signals as output signals.

2. The method according to claim 1, wherein the binaurally filtering and the binaurally equalizing processing is performed in parallel.

3. The method according to claim 1, wherein the binaurally filtered and/or the equalized signals are weighted.

4. The method according to claim 1, further comprising generating initial echoes using the feedback delay network, wherein the plurality of the tap-outs are configured to ensure that the initial echoes are generated at an appropriate time.

5. The method according to claim 1, wherein the at least one filter unit includes a geometrical simulation of a room, and further wherein the binaurally filtering of the input surround audio signals includes simulating all audio reflections in the room up to a selectable number of modeled reflections.

6. The method according to claim 5, wherein the simulating all audio reflections in the room comprises inputting the input surround audio signals through a delay line, wherein the delay line contains one or more tap-outs, wherein a delay of the one or more tap-outs is within the selectable number of modeled reflections.

7. A surround audio processing device, comprising:

an input unit for receiving surround audio signals, the input surround audio signals consisting of a plurality of source input channels;

at least one filter unit for binaurally filtering the received input surround audio signals to produce binaurally filtered signals, wherein the at least one filter unit includes a feedback delay network including a plurality of tap-outs, wherein each of the tap-outs in the plurality of tap-outs is configured to have an appropriate number and time index; and at least one equalizing unit for performing a binaural equalizing processing on the input surround audio signals to produce equalized signals, wherein the output signals of the filter units and the output signals of the at least one equalizing unit are combined; and wherein the feedback delay network includes a mixing matrix having a plurality of mixing matrix input channels, and wherein the plurality of the source input channels is coupled to the mixing matrix input channels.

8. The surround audio processing device according to claim 7, comprising:

a first delay unit arranged between the input unit and the at least one equalizing unit for delaying the input surround audio signal before the input surround audio signals are processed by the equalizing unit; and a second delay unit for delaying the equalized signals of the at least one equalizing unit.

9. The surround audio processing device according to claim 7, further comprising a controller for weighting the filtered signals of the at least one filter unit and the equalized signals of the at least one equalizing unit.

10. The surround audio processing device according to claim 7, wherein the at least one filter unit includes a geometrical simulation of a room that is configured to simulate all audio reflections arriving before a selectable number of modeled reflections.

11. A headphone, comprising the surround audio processing device according to claim 7.

* * * * *

UNITED STATES PATENT AND TRADEMARK OFFICE

CERTIFICATE OF CORRECTION

PATENT NO. : 8,885,834 B2
APPLICATION NO. : 12/920578
DATED : November 11, 2014
INVENTOR(S) : Kuhr et al.

It is certified that error appears in the above-identified patent and that said Letters Patent is hereby corrected as shown below:

In the Claims:

Column 19, line 4, claim 6, add "and" after "tap-outs, and wherein a delay of the one...".

Column 19, line 9, claim 7, add "and" after "tap-outs, and wherein each of the tap-outs...".

Column 20, line 5, claim 7, delete "; and" after "are combined~~; and~~ wherein..." and add a "," after "at least one equalizing unit are combined, wherein the feedback delay network...".

Signed and Sealed this
Second Day of June, 2015

Michelle K. Lee

Michelle K. Lee
*Director of the United States Patent and Trademark Office*